US009902080B2

(12) United States Patent
Michel et al.

(10) Patent No.: US 9,902,080 B2
(45) Date of Patent: Feb. 27, 2018

(54) APPARATUSES FOR CUTTING FOOD PRODUCTS

(71) Applicants: Enrique Michel, Dallas, TX (US); John Poole Hildebrand, Flower Mound, TX (US); Keith Alan Barber, Frisco, TX (US); Michael Scot Jacko, Valparaiso, IN (US); Daniel Wade King, Valparaiso, IN (US)

(72) Inventors: Enrique Michel, Dallas, TX (US); John Poole Hildebrand, Flower Mound, TX (US); Keith Alan Barber, Frisco, TX (US); Michael Scot Jacko, Valparaiso, IN (US); Daniel Wade King, Valparaiso, IN (US)

(73) Assignee: Urschel Laboratories, Inc., Chesterton, IN (US)

( * ) Notice: Subject to any disclaimer, the term of this patent is extended or adjusted under 35 U.S.C. 154(b) by 0 days.

(21) Appl. No.: 15/343,471

(22) Filed: Nov. 4, 2016

(65) Prior Publication Data

US 2017/0050329 A1 Feb. 23, 2017

Related U.S. Application Data

(62) Division of application No. 13/719,282, filed on Dec. 19, 2012, now Pat. No. 9,517,572.

(Continued)

(51) Int. Cl.
*B26D 1/36* (2006.01)
*B26D 1/29* (2006.01)

(Continued)

(52) U.S. Cl.
CPC ..... *B26D 1/36* (2013.01); *B26D 1/147* (2013.01); *B26D 1/29* (2013.01); *B26D 1/62* (2013.01);

(Continued)

(58) Field of Classification Search
CPC . B26D 1/29; B26D 1/295; B26D 1/34; B26D 1/345; B26D 1/62; B26D 7/0641;

(Continued)

(56) References Cited

U.S. PATENT DOCUMENTS 2,922,590 A * 1/1960 Bland ..... B27L 11/005 241/298
4,206,671 A * 6/1980 Hoehn ..... B26D 1/02 198/676

(Continued)

*Primary Examiner* — Jason Daniel Prone
*Assistant Examiner* — Richard Crosby, Jr.
(74) *Attorney, Agent, or Firm* — Hartman Global IP Law; Gary M. Hartman; Domenica N. S. Hartman

(57) ABSTRACT

An apparatus for slicing food product to produce food product slices. The apparatus includes a rotatable cutting wheel having two or more knife assemblies. Each knife assembly includes a knife extending radially between a hub and rim of the cutting wheel. The knife has a leading edge facing a direction of rotation of the cutting wheel and a large-amplitude corrugated shape characterized by peaks and valleys. The knife is secured to the hub and rim with a knife holder, and a clamp secures the knife to a first surface of the knife holder. The knife holder and knife are configured to provide continuous and accurate alignment of an individual food product throughout the slicing thereof by the knife of each knife assembly to produce food product slices with a generally parallel-cut cross-section having a uniform thickness and a large-amplitude periodic shape with an amplitude of 0.1 inch or greater.

12 Claims, 28 Drawing Sheets

Related U.S. Application Data

(60) Provisional application No. 61/580,367, filed on Dec. 27, 2011.

(51) Int. Cl.

| | |
|---|---|
| ***B26D 1/62*** | (2006.01) |
| ***B26D 3/26*** | (2006.01) |
| ***B26D 7/06*** | (2006.01) |
| ***B26D 7/26*** | (2006.01) |
| ***B26D 7/32*** | (2006.01) |
| ***B26D 1/147*** | (2006.01) |
| *B26D 1/00* | (2006.01) |

(52) U.S. Cl.
CPC ..... *B26D 3/26* (2013.01); *B26D 7/0641* (2013.01); *B26D 7/0691* (2013.01); *B26D 7/2628* (2013.01); *B26D 7/32* (2013.01); *B26D 2001/006* (2013.01); *Y10T 83/6473* (2015.04)

(58) Field of Classification Search
CPC .. B26D 7/0691; B26D 7/2628; B26D 7/2635; Y10T 83/6472; Y10T 83/6473
USPC ..... 83/402, 403, 404, 407, 408
See application file for complete search history.

(56) References Cited

U.S. PATENT DOCUMENTS 4,523,503 A * 6/1985 Julian ..... B26D 1/03 83/403
4,584,919 A * 4/1986 Bittner ..... B26D 1/03 83/403
4,590,835 A * 5/1986 Matsuo ..... B26D 1/03 83/403
4,601,227 A * 7/1986 Fitzwater ..... B26D 3/22 426/144
4,604,925 A * 8/1986 Wisdom ..... B26D 1/03 144/162.1
4,648,296 A * 3/1987 Wisdom ..... B26D 1/03 83/13
4,813,317 A * 3/1989 Urschel ..... B26D 1/36 83/356.3
5,555,787 A * 9/1996 Barber ..... B23D 35/008 83/403
5,694,824 A * 12/1997 Jacko ..... B26D 1/03 83/403
5,980,383 A * 11/1999 Medley ..... A01D 61/008 460/114
5,992,284 A * 11/1999 Bucks ..... B26D 1/0006 83/663
6,536,691 B2 * 3/2003 Prewitt ..... A01J 27/04 241/101.01
6,883,411 B2 * 4/2005 Arrasmith ..... B26D 1/02 416/187
6,968,765 B2 * 11/2005 King ..... B26D 1/03 83/403
6,973,862 B2 * 12/2005 Bucks ..... B26D 7/0658 83/13
7,000,518 B2 * 2/2006 Bucks ..... B26D 1/29 83/402
7,178,440 B2 * 2/2007 Bucks ..... B26D 1/29 83/591
7,364,104 B2 * 4/2008 Chojnacki ..... A24B 7/12 241/277
8,033,204 B2 * 10/2011 Bucks ..... B26D 1/0006 83/349
8,161,856 B2 * 4/2012 Jacko ..... B26D 1/03 83/403
9,193,086 B2 * 11/2015 Jacko ..... B26D 7/2614
9,517,572 B2 * 12/2016 Michel ..... B26D 7/0691
2004/0079211 A1 * 4/2004 Walker ..... B26D 1/02 83/165
2009/0202694 A1 * 8/2009 Julian ..... B26D 1/38 426/506
2010/0263510 A1 * 10/2010 Klockow ..... B26D 1/02 83/162
2016/0067877 A1 * 3/2016 Cogan ..... B26D 7/2614 83/13

* cited by examiner

A = AMPLITUDE
Ø = INCLUDED ANGLE
T = WEB THICKNESS
Ro = OUTSIDE (PEAK) RADIUS
Ri = INSIDE (VALLEY) RADIUS
P = PITCH

RUFFLES SLICE

APPARATUSES FOR CUTTING FOOD PRODUCTS

CROSS REFERENCE TO RELATED APPLICATIONS

This is a division patent application of co-pending U.S. patent application Ser. No. 13/719,282, filed Nov. 19, 2012, which claims the benefit of U.S. Provisional Application No. 61/580,367, filed Dec. 27, 2011. The contents of these prior applications are incorporated herein by reference.

BACKGROUND OF THE INVENTION

The present invention generally relates to methods and equipment for cutting food products. More particularly, this invention relates to apparatuses suitable for cutting food product slices having relatively large amplitude cross-sections.

Various types of equipment are known for slicing, shredding and granulating food products, such as vegetable, fruit, dairy, and meat products. A widely used line of machines for this purpose is commercially available from Urschel Laboratories, Inc., under the name Urschel Model CC®, an embodiment of which is represented in FIG. 1. The Model CC® machine line provides versions of centrifugal-type slicers capable of producing uniform slices, strip cuts, shreds and granulations of a wide variety of food products at high production capacities.

FIGS. 2 and 3 are perspective views of an impeller 310 and cutting head 312, respectively, of types that can be used in the Model CC® machine. In operation, the impeller 310 is coaxially mounted within the cutting head 312, which is generally annular-shaped with cutting knives 314 mounted on its perimeter. The impeller 310 rotates within the cutting head 312, while the latter remains stationary. Each knife 314 projects radially inward toward the impeller 310 in a direction generally opposite the direction of rotation of the impeller 310, and defines a cutting edge at its radially innermost extremity. As represented in FIG. 4, the impeller 310 has generally radially-oriented paddles 316 with faces that engage and direct food products (e.g., potatoes) radially outward against the knives 314 of the cutting head 312 as the impeller 310 rotates.

FIG. 1 schematically represents the cutting head 312 mounted on a support ring 328 above a gear box 330. A housing 332 contains a shaft coupled to the gear box 330, through which the impeller 310 is driven within the cutting wheel 312. Further descriptions pertaining to the construction and operation of Model CC® machines are contained in U.S. Pat. Nos. 5,694,824 and 6,968,765, the entire contents of which are incorporated herein by reference.

The cutting head 312 shown in FIG. 3 comprises a lower support ring 318, an upper mounting ring 320, and circumferentially spaced support segments (shoes) 322. The knives 314 of the cutting head 312 are individually secured with clamping assemblies 26 to the shoes 322, which are secured with bolts 325 to the support and mounting rings 318 and 320. The shoes 322 are equipped with coaxial pivot pins (not shown) that engage holes in the support and/or mounting rings 318 and 320. By pivoting on its pins, the orientation of a shoe 322 can be adjusted to alter the radial location of the cutting edge of its knife 314 with respect to the axis of the cutting head 312, thereby controlling the thickness of the sliced food product. As an example, adjustment can be achieved with an adjusting screw and/or pin 324 located circumferentially behind the pivot pins. FIG. 3 further shows optional gate insert strips 323 mounted to each shoe 322, which the food product crosses prior to encountering the knife 314 mounted to the succeeding shoe 322.

The knives 314 shown in FIG. 3 are depicted as having straight cutting edges for producing flat slices, though other shapes are also used to produce sliced and shredded products. For example, the knives 314 can have cutting edges that define a periodic pattern of peaks and valleys when viewed edgewise. The periodic pattern can be characterized by sharp peaks and valleys, or a more corrugated or sinusoidal shape characterized by more rounded peaks and valleys when viewed edgewise. If the peaks and valleys of each knife 314 are aligned with those of the preceding knife 314, slices are produced in which each peak on one surface of a slice corresponds to a valley on the opposite surface of the slice, such that the slices are substantially uniform in thickness but have a cross-sectional shape that is characterized by sharp peaks and valleys ("V-slices") or a more corrugated or sinusoidal shape (crinkle slices), collectively referred to herein as periodic shapes. Alternatively, shredded food product can be produced if each peak of each knife 314 is aligned with a valley of the preceding knife 314, and waffle/lattice-cut food product can be produced by intentionally making off axis alignment cuts with a periodic-shaped knife, for example, by cross cutting a food product at two different angles, typically ninety degrees apart. Whether a sliced, shredded or waffle-cut product is desired will depend on the intended use of the product.

Equipment currently available for cutting food product, such as those represented in FIGS. 1-4, are well suited for producing slices of a wide variety of food products, but have shown to be incapable of producing V-slices and crinkle slices having relatively large amplitude cross-sections without incurring unacceptable levels of through-slice cracking, or at minimum undesirable surface cracking and surface roughness. As used herein, large amplitude refers to cross-sections with amplitudes of about 0.1 inches (about 2.5 mm) or greater.

BRIEF DESCRIPTION OF THE INVENTION

The present invention provides apparatuses suitable for cutting food product slices having relatively large amplitude cross-sections.

According to one aspect of the invention, an apparatus for cutting food product includes an annular-shaped cutting head and an impeller coaxially mounted within the cutting head for rotation about an axis of the cutting head in a rotational direction relative to the cutting head. The impeller includes one or more paddles circumferentially spaced along a perimeter thereof for delivering food product radially outward toward the cutting head. The cutting head includes one or more knife assemblies arranged in sets spaced around the circumference of the cutting head. Each knife assembly includes a knife extending radially inward toward the impeller in a direction opposite the rotational direction of the impeller and is adapted to secure the knife to the cutting edge. The knife has a corrugated shape to produce a food product slice with generally parallel cuts wherein the food product slice has a periodic shape and a large-amplitude cross-section.

According to another aspect of the invention, an apparatus for cutting food product includes a cylindrical-shaped cutting head mounted for rotation about a horizontally disposed central axis of rotation. The cutting head includes a circular-shaped front opening and a circumferential wall defined in part by at least one knife assembly having an axially extending knife and means for securing the knife to the cutting head. The knife has a corrugated shape to produce a food product slice with generally parallel cuts, wherein the food product slice has a periodic shape and a large-amplitude cross-section. The apparatus is adapted to rotate the cutting head about the central axis of rotation. A stationary hollow elongate feed chute is disposed through the front opening and includes an inlet opening and an outlet opening for containing and consecutively feeding a supply of food products to the knife. The longitudinal axis of the feed chute intersects the circumferential wall of the cutting head approximately midway between the opposite ends of the wall and spaced rearwardly of the axis of rotation with respect to the direction of cutting head rotation to dispose the outlet opening of the feed chute adjacent the lower circumferential wall portion of the cutting head so that each food product is caused to engage the lower circumferential wall portion of the cutting head for slicing by the knife during rotation of the cutting head.

According to yet another aspect of the invention, an apparatus for cutting food product includes a rotatable cutting wheel wherein the food product advances towards the cutting wheel in a feed direction. The cutting wheel has a hub, a rim, and at least one knife assembly including a knife and means for securing the knife to the cutting wheel. The knife has a leading edge facing a direction of rotation of the cutting wheel and extending generally radially from the hub to the rim. A cutting edge on the leading edge of the knife and a second edge on the trailing edge of the knife assembly with respect to the direction of cutting wheel rotation form a juncture. The juncture extends substantially parallel to and spaced in the food product feed direction from the cutting edge of an adjacent surface located in a trailing direction so as to form an opening therebetween. The opening determines a thickness of the sliced food product engaging the knife while the cutting wheel is rotated about a central axis to advance the cutting edge in a cutting plane. The knife has a corrugated shape to produce a food product slice with generally parallel cuts wherein the food product slice has a periodic shape and a large-amplitude cross-section.

A technical effect of the invention is the ability to produce a food product slice having a large amplitude cross-section with minimal through-cracking and abrasion on the peaks of the slices.

Other aspects and advantages of this invention will be better appreciated from the following detailed description.

DETAILED DESCRIPTION OF THE INVENTION

The present invention provides cutting apparatuses capable of producing a variety of food products, including chips from potatoes, and to the resulting sliced food product produced with the apparatus. Although the invention will be described herein as cutting food product, it is foreseeable that the cutting apparatuses may be used for cutting other materials and therefore the scope of the invention should not be limited to food products. The cutting apparatuses are preferably adapted to cut food products into slices with generally parallel cuts resulting in food product slices having cross-sections with an amplitude of at least 0.1 inches (about 2.5 mm) or greater. Preferably, the cutting apparatuses are adapted to produce food product slices having cross-sections with a large amplitude of about 0.100 to 0.350 inch (about 2.5 to 9 mm), more preferably of about 0.12 to 0.275 inch (about 3 to 7 mm), and most preferably of about 0.15 to 0.225 inch (about 3.8 to 5.7 mm).

For convenience, consistent reference numbers are used in reference to a first embodiment of the invention, including but not limited to representations in FIGS. 5, 8, 11*e*, 12, and 13*c*, to denote the same or functionally equivalent elements as described in FIGS. 1-4. FIGS. 17-23 depict additional embodiments of the invention in which consistent reference numbers are used to identify the same or functionally equivalent elements, but with a numerical prefix (1, 2, or 3, etc.) added to distinguish the particular embodiment from the first embodiment.

Figure 1:
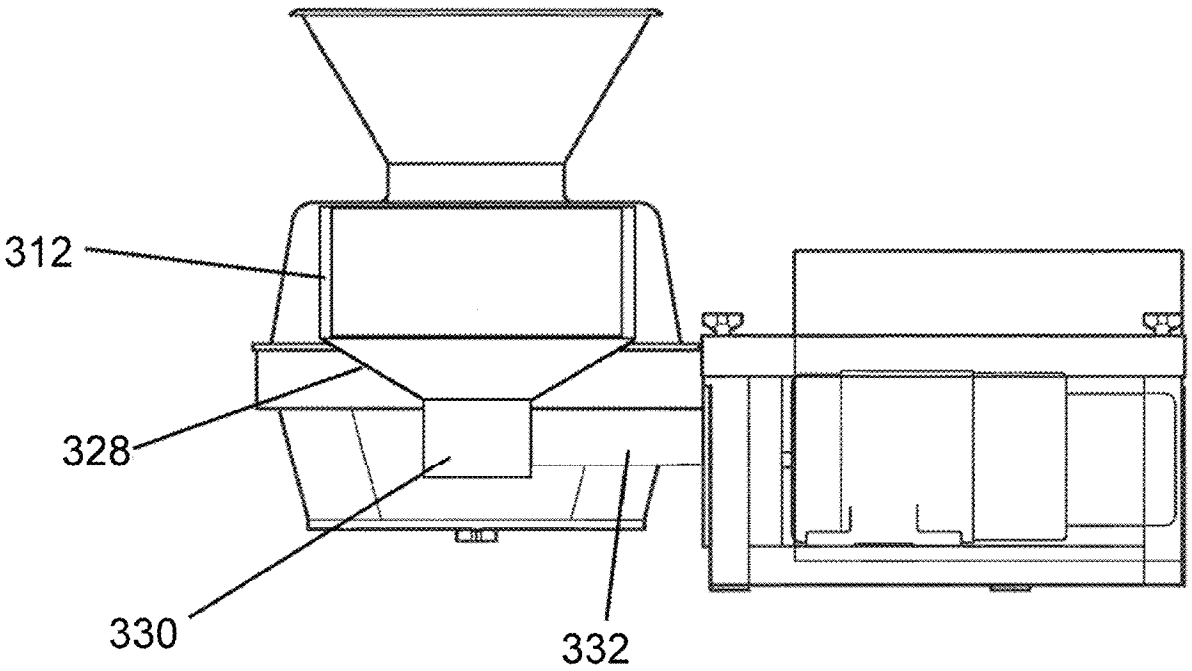
FIG. 1 (Prior Art)
FIG. 1 is a plan view representing a cutting apparatus known in the art.
Figure 2:
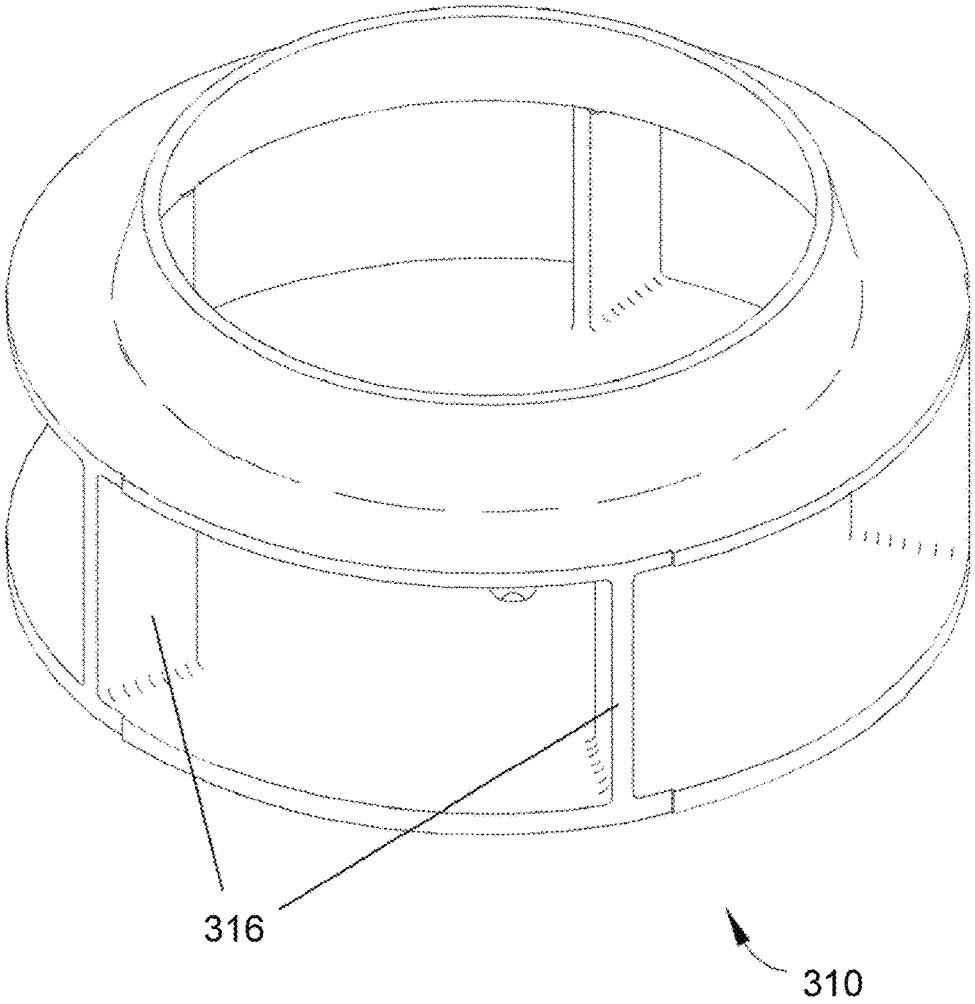
FIG. 2 (Prior Art)
FIG. 2 is a perspective view representing an impeller of a cutting apparatus known in the art.
Figure 3:
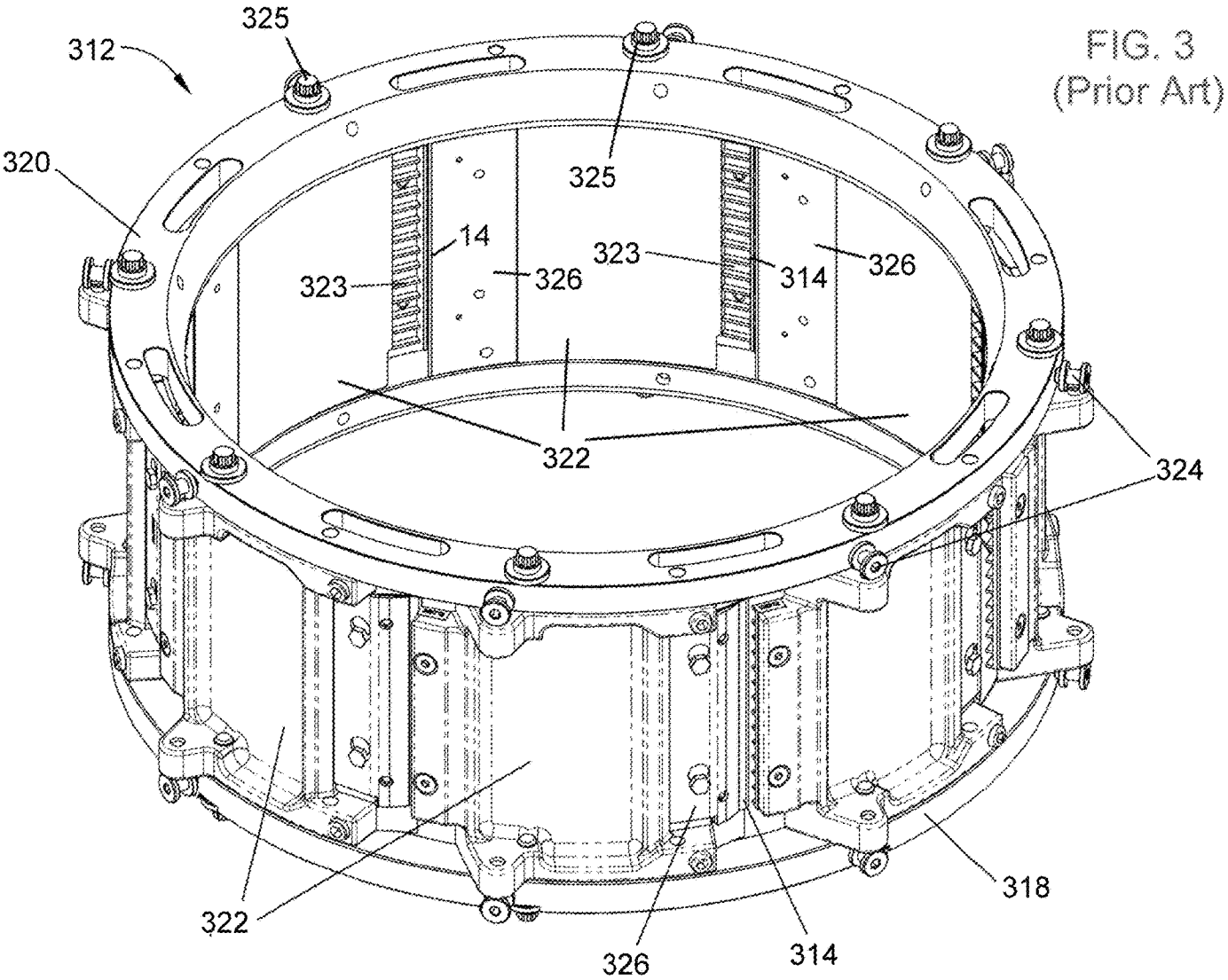
FIG. 3 (Prior Art)
FIG. 3 is a perspective view representing a cutting head of a cutting apparatus known in the art.
Figure 4:
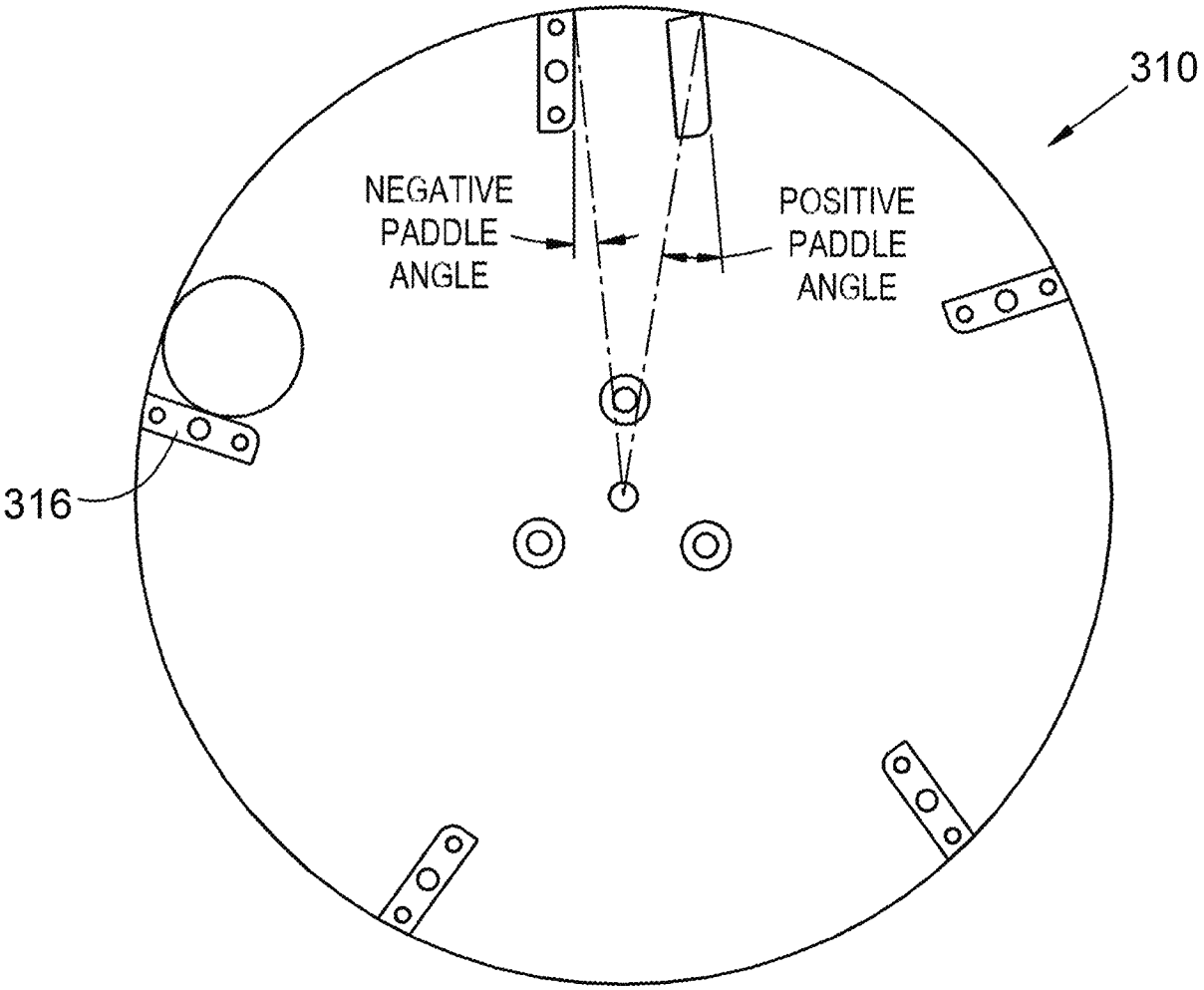
Fig. 4 (Prior Art)
FIG. 4 is a top view representing paddle angles of the impeller of FIG. 2.
Figure 5:
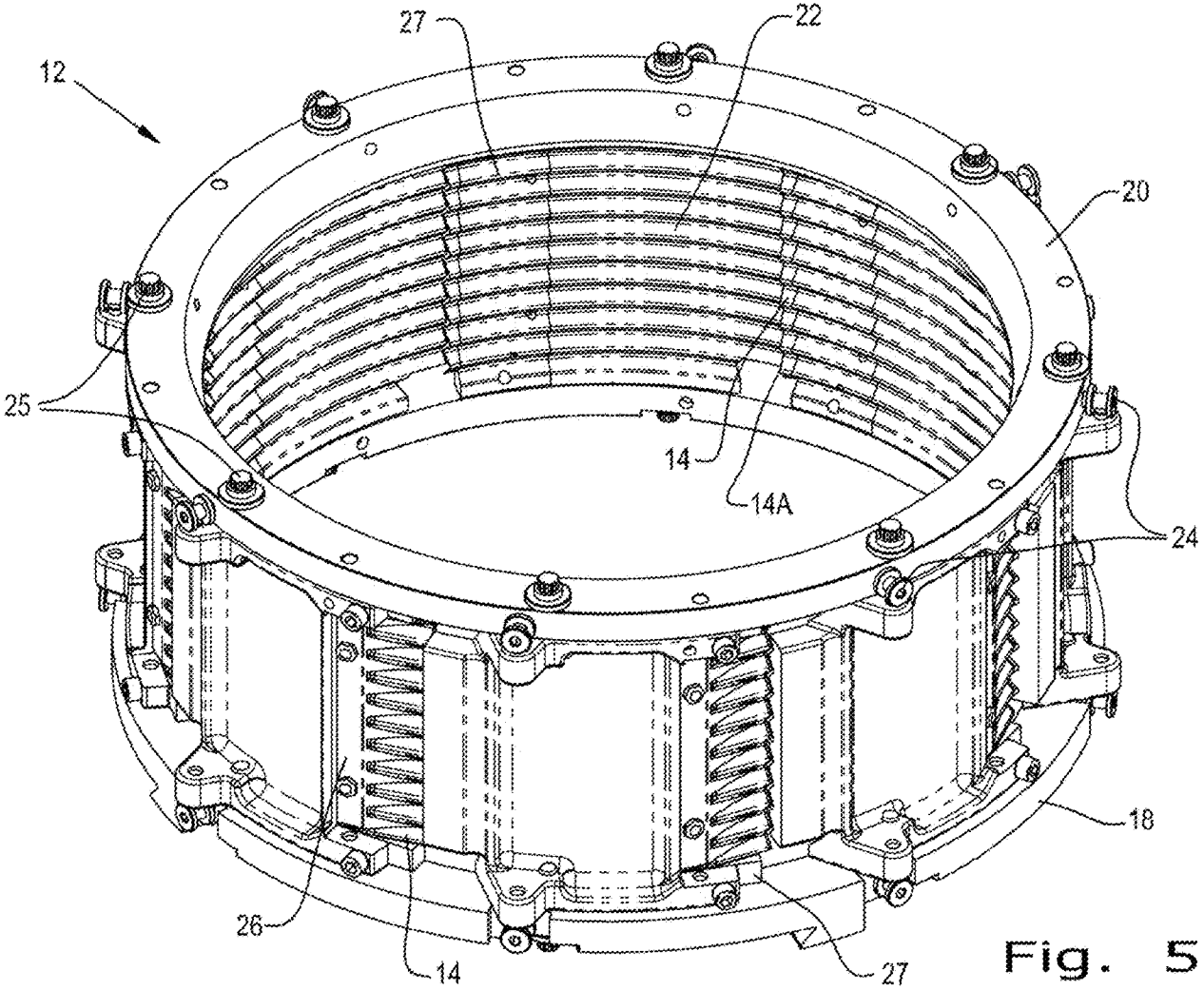
FIG. 5 is a perspective view representing a cutting head in accordance with an aspect this invention.

The cutting apparatus of the first embodiment is represented in FIG. 5 as comprising an annular-shaped cutting head 12. The cutting head 12 is configured for operation with an impeller 10, such as of the types represented in FIGS. 2 and 4, and can be used in various types of machines including that represented in FIG. 1. Regardless of its particular configuration, the impeller 10 is coaxially mounted within the cutting head 12 for rotation about an axis of the cutting head 12 in a rotational direction relative to the cutting head 12. Furthermore, the impeller 10 comprises at least one paddle 16 and preferably multiple paddles 16 circumferentially spaced along a perimeter thereof for delivering food product radially outward toward the cutting head 12. The cutting head 12 comprises at least one and preferably multiple knife assemblies arranged in sets spaced around the circumference of the cutting head 12. Each knife assembly includes a knife 14 and means for securing the knife 14 to the cutting head 12. In the embodiment shown in FIG. 5, the securing means comprises a shoe 22, a knife holder 27 mounted to the shoe 22, and a clamp 26 that secures the knife 14 to the knife holder 27. Though shown as discrete components, the knife 14 and holder 27 or the shoe 22 and holder 27 could be fabricated as an integral unitary piece. Although the securing means of the knife assembly is represented as comprising a shoe 22, knife holder 27, and clamp 26, it is foreseeable that the knife 14 could be secured by other means such as, but not limited to, fasteners or bolts. The knife 14 is mounted to extend radially inward toward the impeller 10 and has a cutting edge 48 that terminates at a knife tip 14*a* projecting toward the impeller 10.

Figure 6:
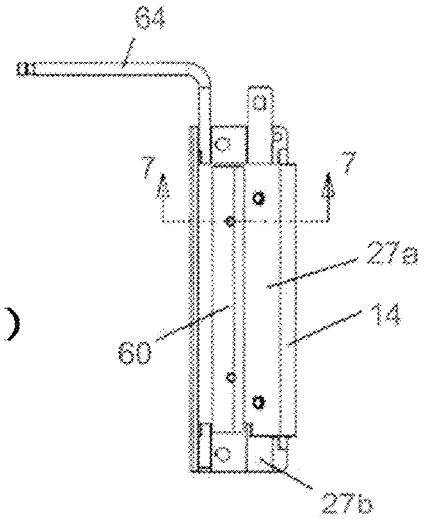
FIG. 6 (Prior Art)
FIGS. 6 and 7 are side and cross-sectional views, respectively, of a quick clamping assembly in accordance with an aspect of the invention.
Figure 7:
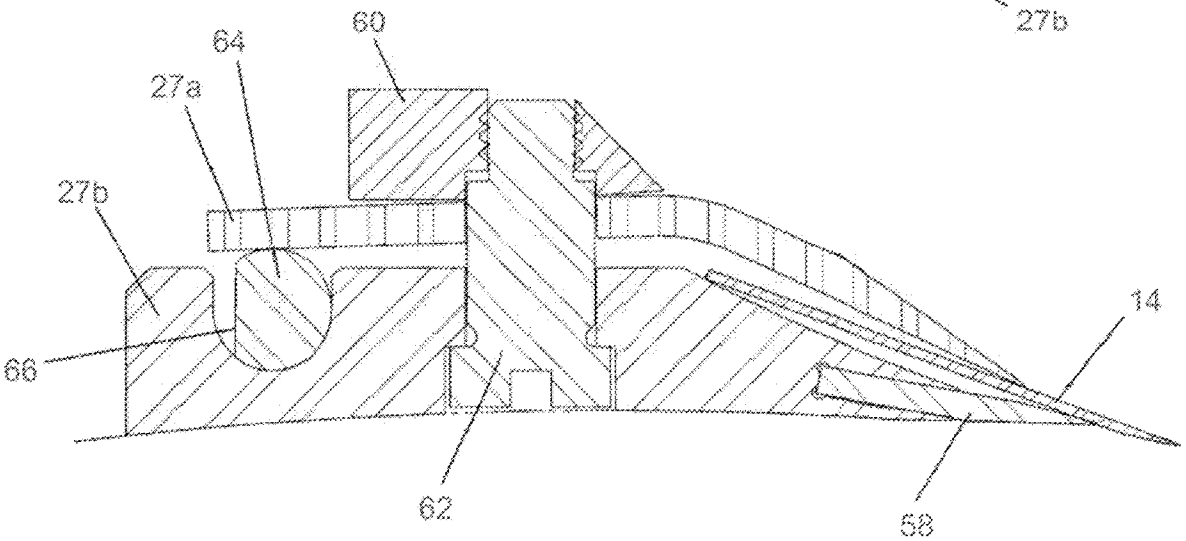
FIG. 7 (Prior Art)

Alternatively or in addition, the clamp 26 may be a quick clamping device that allows for relatively quick removal of the knife assembly from the cutting head 12, for example, as disclosed in U.S. Pat. No. 7,658,133, whose subject matter relating to a quick clamping device is incorporated herein by reference. An exemplary quick clamping device is represented in FIGS. 6 and 7. As represented, the knife 14 is secured to the knife assembly by a radially outer knife holder 27*a* and a radially inner knife holder 27*b*. In this particular example, the knife holder 27*b* comprises an insert 58 that serves to protect the edge of the knife holder 27*b* from debris. A clamping rod 60 is secured to the radially inner holder 27*b* with a fastener 62. As evident from FIGS. 6 and 7, the lever 64 has forced one end of the radially outer holder 27*a* against the clamping rod 78, which in turn forces the opposite end of the radially outer holder 27*a* into engagement with the knife 14, forcing the knife 14 against the radially inner holder 27*b*. The knife 14 can be release by rotating the lever 64 clockwise (as viewed in FIG. 7), such that a flat 66 on the lever 64 faces the radially outer holder 27*a*, releasing the radially outer holder 27*a* from its engagement with the clamping rod 60.

Figure 8:
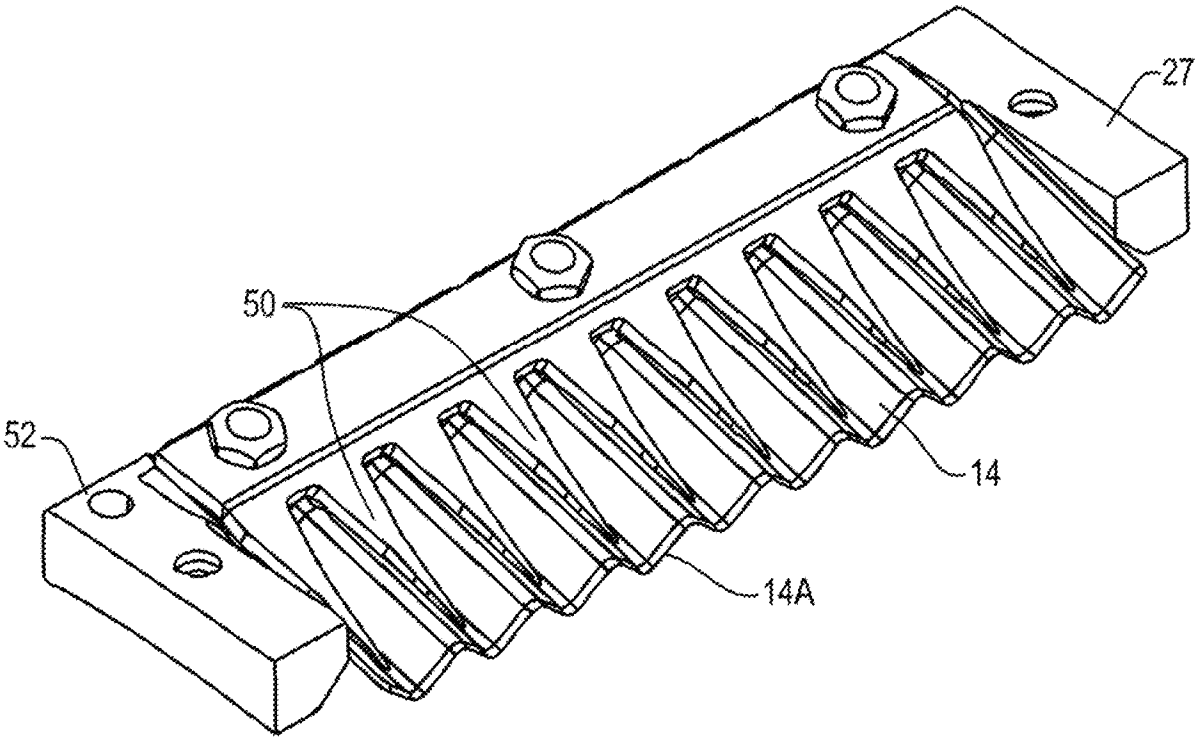
FIG. 8 is a perspective view representing a knife assembly in accordance with an aspect this invention.
Figure 9:
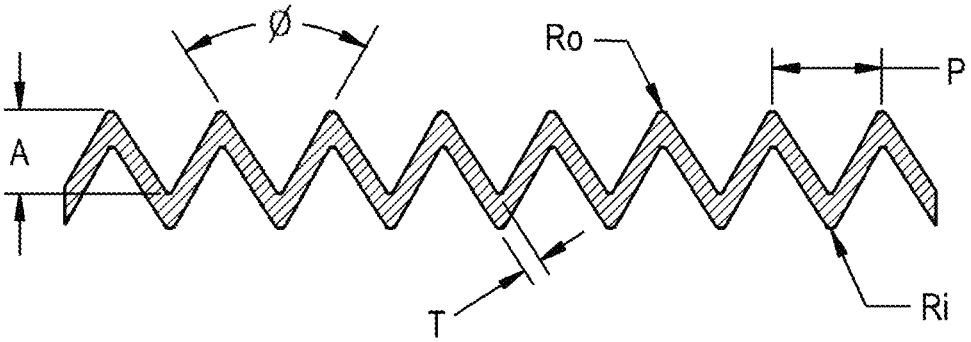
Fig. 9 (Prior Art)
FIG. 9 is a cross-sectional view of a chip having a periodic shape and a large-amplitude cross-section in accordance with an aspect this invention.
Figure 9:
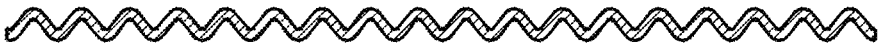
Fig. 9 (Prior Art)

According to a first aspect of the invention, the knives 14 are corrugated as represented in FIG. 8 to produce a food product slice having a periodic shape and a large-amplitude cross-section of the type shown in FIG. 9. FIG. 9 also references variables that help to define the shape of the food product slice, including a definition of "amplitude" as based on a distance "A" between an adjacent peak and valley of the product. The cross-section represented in FIG. 9 is referred to herein as a parallel cut in the sense that the product has a generally uniform web thickness, as opposed to the variable and discontinuous thickness of a waffle/lattice cut. Whereas pitch, included angle, web thickness, outside (peak) radius, and inside (valley) radius are all of interest to producing potato chips and a variety of other food products having consumer appeal, the invention is particularly concerned with chips having cross-sections with large amplitudes of about 0.100 inch (about 2.5 mm) and greater.

According to another aspect of the invention, FIG. 8 shows the clamp 26 used to secure the knife 14 to the knife holder 27 as having fingers 50 that engage the valleys defined by the corrugated shape of the knife 14. Due to the large amplitude of the slices (chips) being sought, a conventional clamp 26 of the types often used with Model CC® machines, represented in FIG. 3, likely could not be used for manufacturing and material reasons. Consequently, the toothed clamp 26 seen in FIGS. 5 and 8 were manufactured to secure each knife 14 to its knife holder 27. Various embodiments of the clamp 26 were investigated. For example, in one embodiment, the peaks of the knife 14 are not contacted by the clamp 26. In an additional embodiment, the bend line of the clamp 26 was positioned behind the base of the fingers 50 to maintain the stiffness of the clamp 26. However, this embodiment resulted in a relatively steep outer surface of the clamp 26 that slices were required to surmount after slicing, which had the unintended consequence of producing through-slice cracks.

Figure 10:
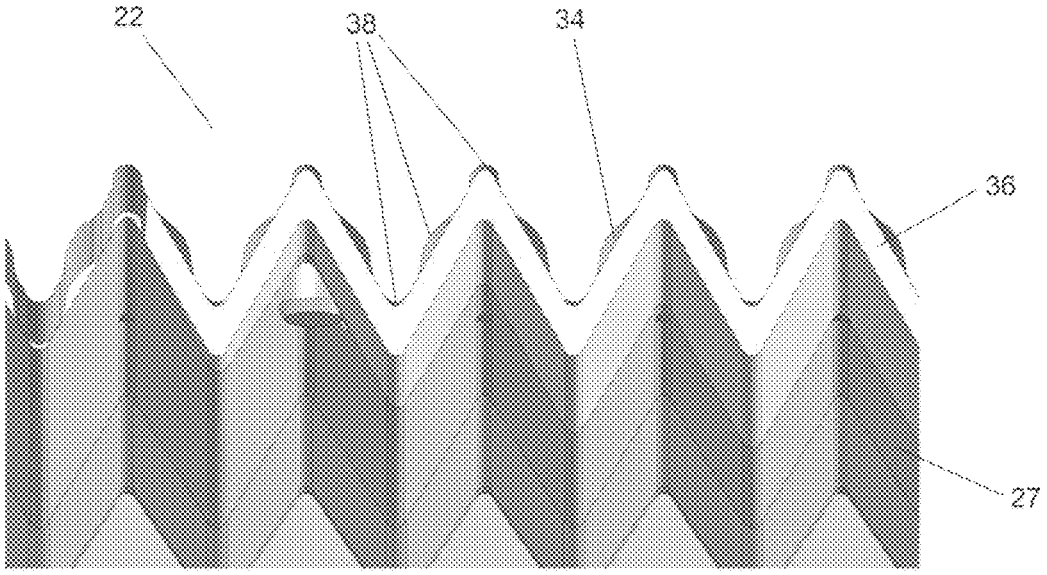
FIG. 10 is a perspective view representing a knife assembly with a relieved shoe in accordance with an aspect this invention.

For reasons discussed in reference to FIGS. 11*a* through 11*e*, the fingers 50 of the clamp 26 shown in FIG. 8 are beveled on the surface of the clamp 26 facing the impeller 10. The clamp 26 is also shown as having more than two fasteners (three in FIG. 8) to achieve a more uniform clamping pressure across the length of the knife 14. As shown in FIG. 5, the surface of each shoe 22 and knife holder 27 facing the impeller 10 has a corrugated shape corresponding to the corrugated shape of its knife 14, which is intended to provide continuous and accurate alignment of individual food products throughout the slicing thereof by the knives 14. While FIG. 5 represents the entirety of these surfaces as continuously and uniformly corrugated, it is foreseeable that only portions immediately adjacent the knife assemblies might be corrugated. Furthermore, the corrugated shapes of the shoes 22 and knife holders 27 can be relieved in key areas (shaped differently than the knife geometry) to minimize surface contact (and the proportional surface friction) between the unsliced food product and the cutting head 12 to minimize the amount of additional energy required to rotate the impeller 10 while pushing food product. Such an effect is represented in FIG. 10, which shows a sectional view of a shoe 22, knife holder 27, and food product slice during the slicing operation. Grooves defined by the corrugation shape in the shoe surface 34 are not fully complementary to the cross-sectional shape of the slice as a result of the shoe surface 34 having localized reliefs or recesses 38 located at the peaks and valleys of the slice as well as midway therebetween.

According to a preferred aspect of the invention, the knife holders 27 comprise means for accurately aligning their corrugated shapes with the corrugated shapes of their respective shoes 22, preferably to achieve a linear misalignment of less than 0.004 inch (about 0.1 mm), more preferably less than 0.001 inch (about 0.025 mm), and most preferably less than 0.0005 inch (about 0.013 mm). In the particular embodiment represented in FIG. 8, the alignment means is shown as a pin hole 52 that can be used to align the knife holder 27 to its shoe 22 (not shown in FIG. 8), though other means for accurately aligning the knife holder corrugations with the corrugations in the shoe 22 are also foreseeable and within the scope of the invention.

According to yet another aspect of the invention, the knife holders 27, knives 14, and knife clamps 26 are adjusted to have a relatively low rake-off angle to reduce the probability of slice damage. As used herein, the term "rake-off angle" is measured as the angle that a slice has to deviate relative to a tangent line that begins at the intersection of the radial path of the product sliding surface of the leading shoe 22 and the knife edge. The line is then tangent to the radial product sliding surface of the leading shoe 22. This angle of deviation is a function of both the hardware and the gap setting ("$d_{gap}$") at which the entire knife holder 27, knife 14, and shoe assembly is positioned. FIGS. 11*a* through 11*e* represent a series of iterations that were investigated, during which knife angles, rake-off angles, knife extensions, and clamp set-back distances were explored. (The meanings of these terms are identified in FIGS. 11*a* through 11*e*). The investigation explored knife angles ("$\theta_h$") within the knife holder 27 of about 11 degrees to about 15 degrees (corresponding to knife angles ("$\theta_t$") relative to the tangent line ("$L_{shoe}$") of about 4 degrees to about 8 degrees), rake-off angles ("$\theta_r$") with respect to the tangent ("$L_{shoe}$") of about 17 degrees to about 27 degrees, radial knife extensions ("$d_{pos}$") of about 0.0002 inch to 0.011 inch, and clamp set-back distances ("$d_{set}$") of about 0.150 inch to 0.330 inch. For example, one approach was to reduce the knife angle $\theta_h$ (within the holder) from a conventional angle of about fifteen degrees to as low as 11.25 degrees. In theory, as the rake-off angle $\theta_r$ approaches zero, the resultant stress in the sliced product should be reduced and the instances of slice cracking will be decreased and the slice quality should increase. However, in order to maintain the same relative radial knife extension $d_{pos}$, defined as a distance between the cutting edge 48 of the knife 14 and a line ("$L_{holder}$") tangent to an inside radius of the trailing knife holder 27, and gap setting $d_{gap}$ at these extremely low angle configurations, it was required to make extremely long lateral knife extensions ("$d_{ext}$") of about 0.1 to about 0.2 inch. Surprisingly, the compromises in knife position that these minimum knife angle configurations required did not result in the expected improvements in slice quality metrics. One embodiment combined a knife angle $\theta_h$ within the holder of about 12.5 degrees (knife angle $\theta_t$ relative to the tangent of about 4.5 degrees), a rake-off angle $\theta_r$ of about 17 degrees, a radial knife extension $d_{pos}$ of about 0.011 inch and a clamp set-back $d_{set}$ of about 0.200 inch.

Figure 11A:
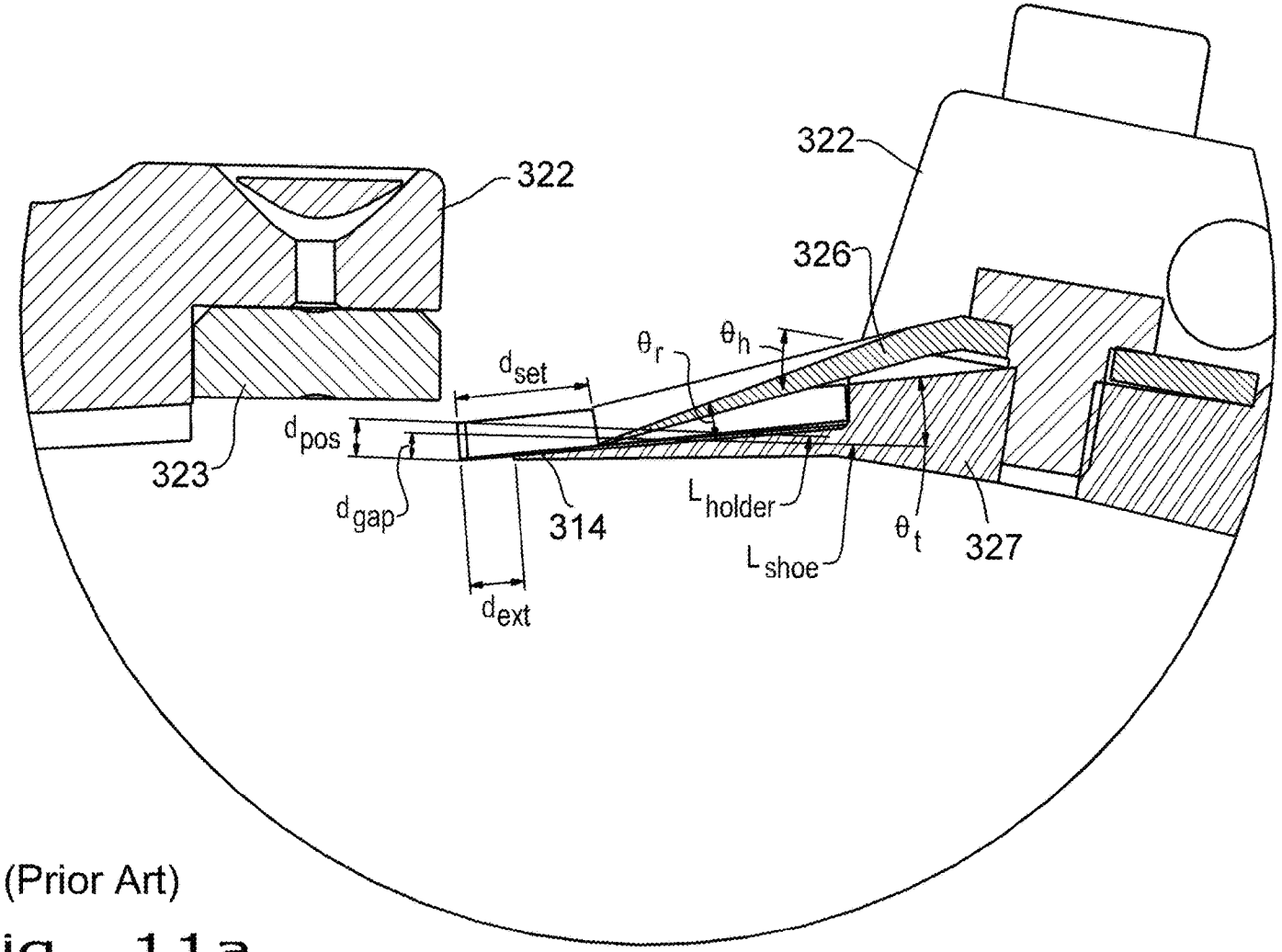
(Prior Art) Fig. 11a
FIGS. 11*a-e* are plan views representing various knife assembly configurations in accordance with an aspect this invention.
Figure 11B:
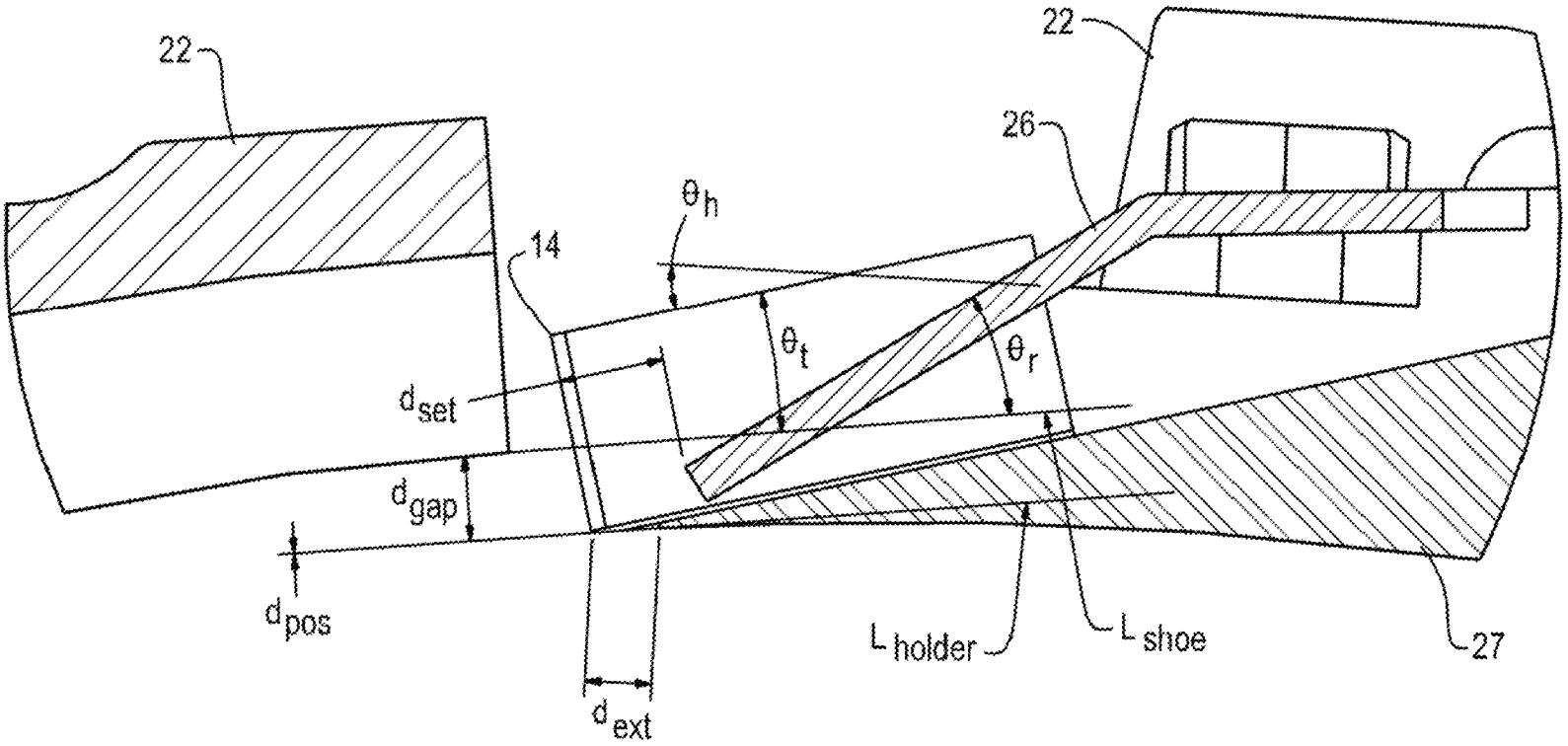
Figure 11C:
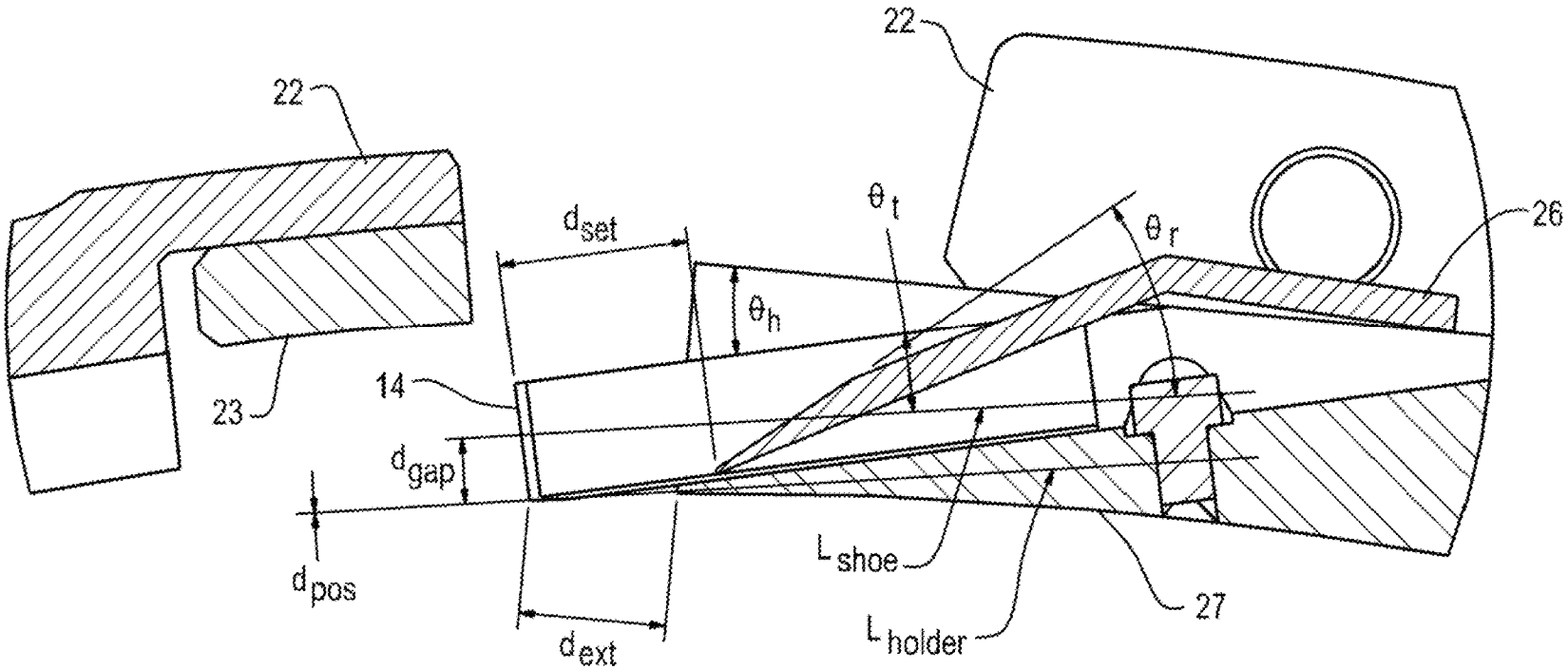
Figure 11D:
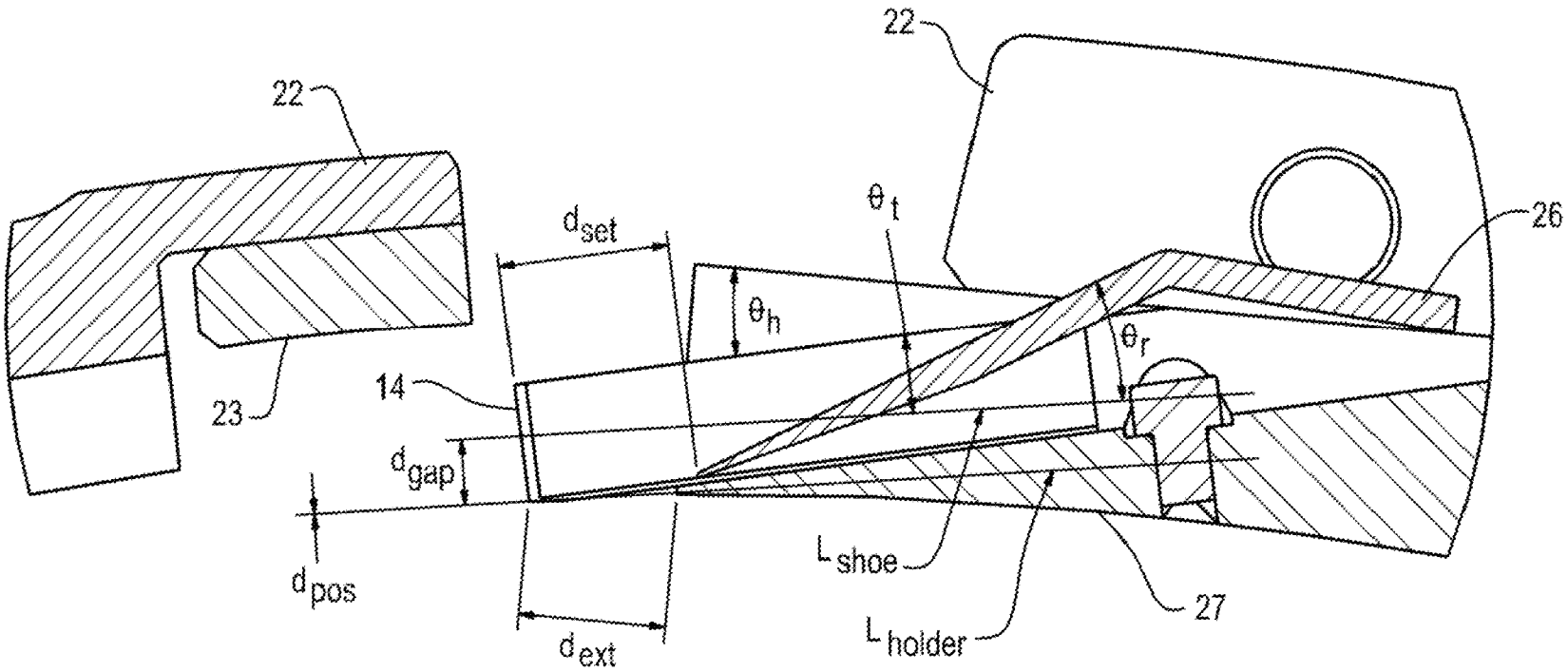
Figure 11E:
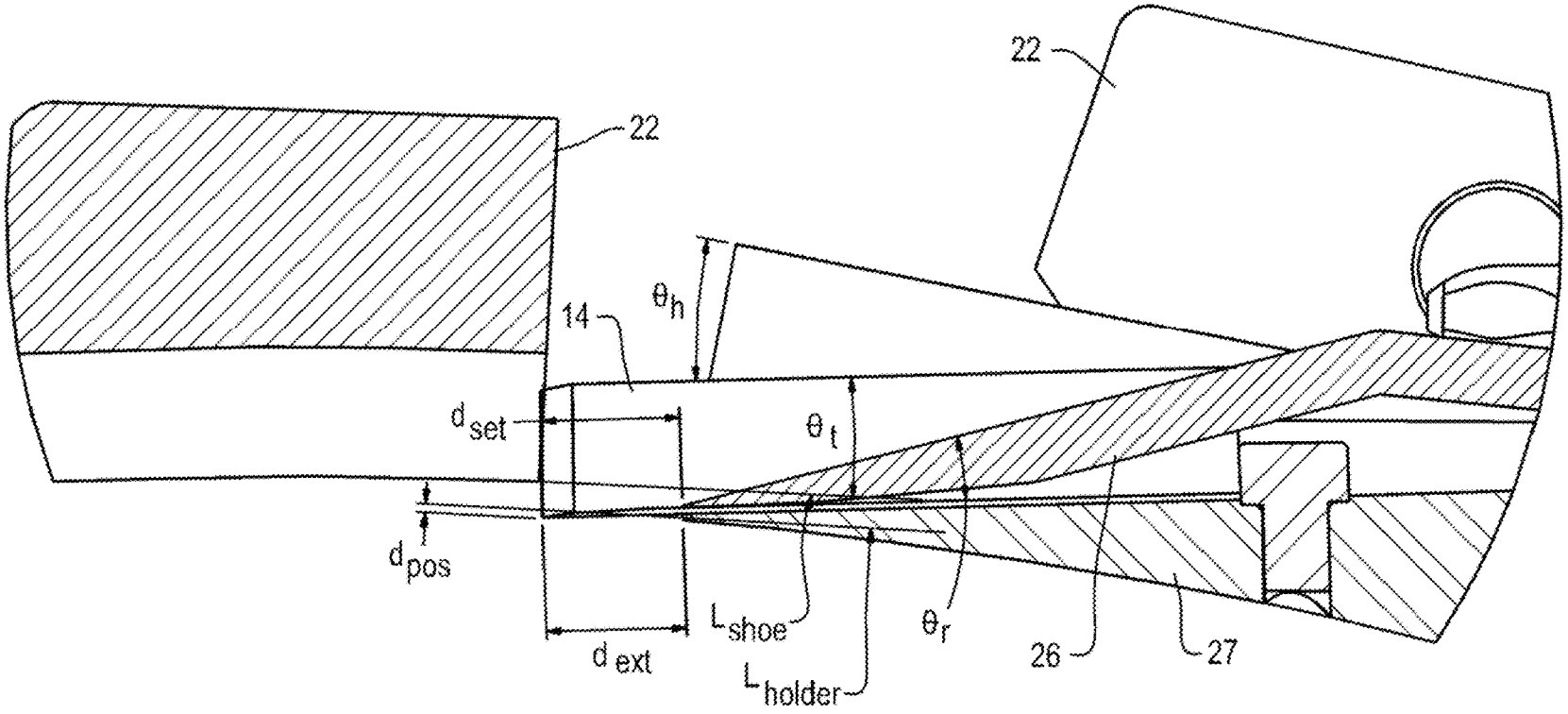

Several different clamps 26 with different geometries were also evaluated in an effort to lower the rake-off angle $\theta_r$ and the probability that slice cracking would occur. Some of these evaluations are represented in FIGS. 11*a* through 11*e*, which include different (radially outward and inward) clamp bevels. FIG. 11*a* represents a prior art configuration including a knife 314 having a corrugated shape for making shaped cuts, a knife angle $\theta_h$ within the knife holder 327 of about 15 degrees, a radial knife extension $d_{pos}$ of about 0.070 inch, a clamp set back $d_{set}$ of about 0.260 inch, and a rake-off angle $\theta_r$ of about 21 degrees. FIG. 11*b* represents an experimental configuration in which the knife angle $\theta_h$ within the knife holder 27 was about 15 degrees, a radial knife extension $d_{pos}$ of about 0.003 inch, a clamp set back $d_{set}$ of about 0.160 inch, and the rake-off angle $\theta_r$ is about 27 degrees. Solutions to two immediate issues needed to be resolved: slice cracking and abrasion on the peaks of slices when attempting to produce slices having large amplitudes of 0.100 inch (about 2.5 mm) or greater. FIGS. 11*c* and 11*d* represent subsequent steps in the investigation. In FIG. 11*c*, the fingers 50 of the clamp 26 were beveled on their surfaces facing away from the impeller 10 to reduce the instances of abrasion on the peaks of the slice which contact the clamp 26. The bevel reduced the knife angle $\theta_h$, but resulted in a locally greater rake-off angle $\theta_r$ that increased slice cracking. The rake-off angle $\theta_r$ was then decreased further by moving the bevel to the radially inward side of the clamp 26 facing the impeller 10 (FIG. 11*d*), thereby maintaining a smooth transition for slices. In addition, the bend angle was reduced and the finger lengths shortened. In order to address abrasion on the peaks which contact the inner sliding surface of the shoe 22, knife extension values were explored using equipment represented by FIG. 11*d* from about 0.135 inch to about 0.570 inch. This particular abrasion was determined to be reduced with larger radial knife extensions $d_{pos}$. FIG. 11*e* represents what is believed to be an embodiment that retains the inward bevel of the clamp 26, but further includes a thicker clamp 26 and extended knife position. Based on these investigations it was concluded that, depending on the configuration of the knife assembly used, a sufficiently low rake-off angle $\theta_r$ is considered to be less than 23 degrees, more preferably less than 20 degrees, and most preferably about 17 degrees.

Figure 12:
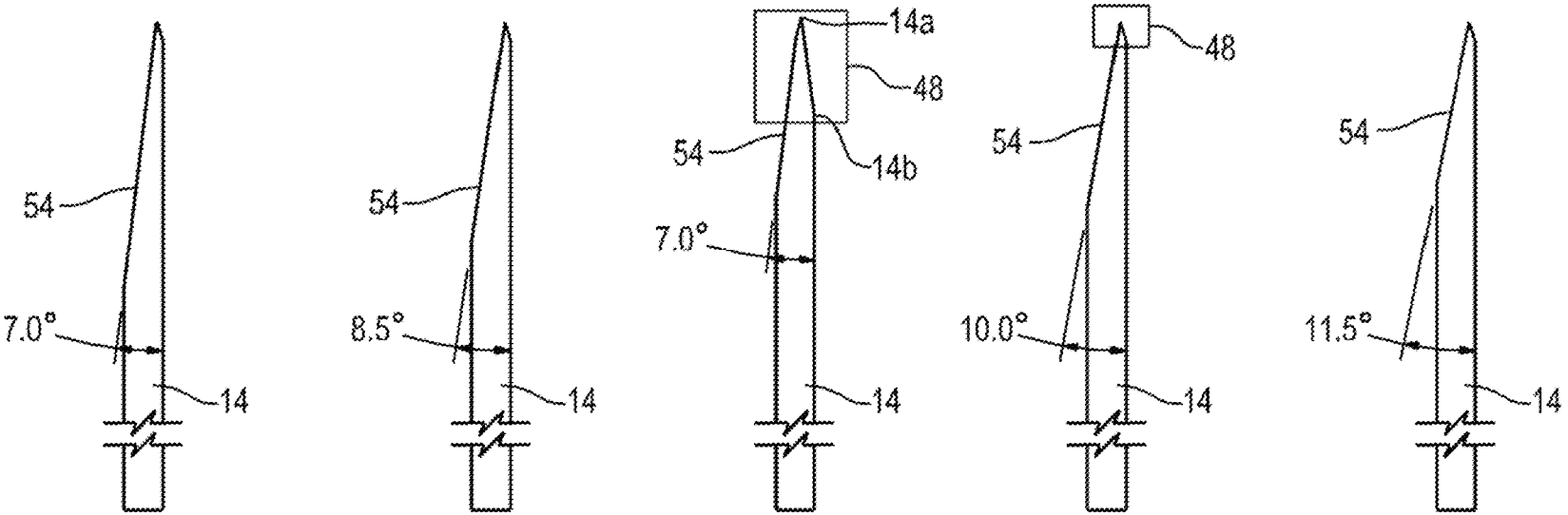
FIG. 12 is a plan view representing profiles of knives with biased bevels in accordance with an aspect this invention.

Furthermore, the knife 14 of FIG. 11*e* has a ground bevel that is biased to one side, preferably facing away from the impeller 10, to improve the slice quality. As used herein, a "biased bevel" refers to a knife edge that is not symmetrical, but instead has different bevels on its opposite sides in terms of angle and/or length, for example, as exemplified by the different biased bevels represented in FIG. 12. The knife tip geometries represented in FIG. 12 were investigated during development. As represented, knives with double (centered) bevels and biased (single or biased) bevels were evaluated, as were knives with different blade widths. The fundamental difference between the biased bevel knives in FIG. 12 is the angle of the primary (wider) bevel 54. Initial evaluations were conducted following prior art best practices with an 8.5 degree inward biased bevel (FIG. 13*b*), meaning that the primary bevel 54 faces toward the center of the impeller 10 at different knife inclinations. Surprisingly, the performance with this orientation was poorer than expected. Following exhaustive analysis of the geometry, the primary bevel 54 of the knife 14 was concluded to interfere with the path of the potato after slicing. The biased bevel knife 14 was then inverted (outward biased bevel in FIG. 13*c*) to minimize any interference with the unsliced portion of the potato. Data from subsequent testing validated this approach, such that an outward biased bevel with the primary bevel 54 facing away from the center of the impeller 10 delivered improved slice thickness uniformity. Based on the results of the investigation, primary bevels 54 of about 7 to 10 degrees are believed to be acceptable. One embodiment incorporates an 8.5 degree biased bevel with the primary bevel 54 facing away from the impeller 10.

The knives 14 were initially positioned at a "standard" position, in which the tips 14*a* of the knives 14 were positioned according to prior art practice a distance of about 0.003 inch (about 75 micrometers) radially inward from the nominal inner radius of its shoe 22, which meant different lateral knife positions for each different knife angle within the knife holder 27. During testing, lateral positions of the knife tips 14*a* were varied. In one embodiment, the knife tip 14*a* was located at a lateral distance of 0.195 inch (4.95 mm) and a radial distance of 0.011 inch (0.28 mm), resulting in the configuration shown in FIG. 11*e*.

Figure 13A:
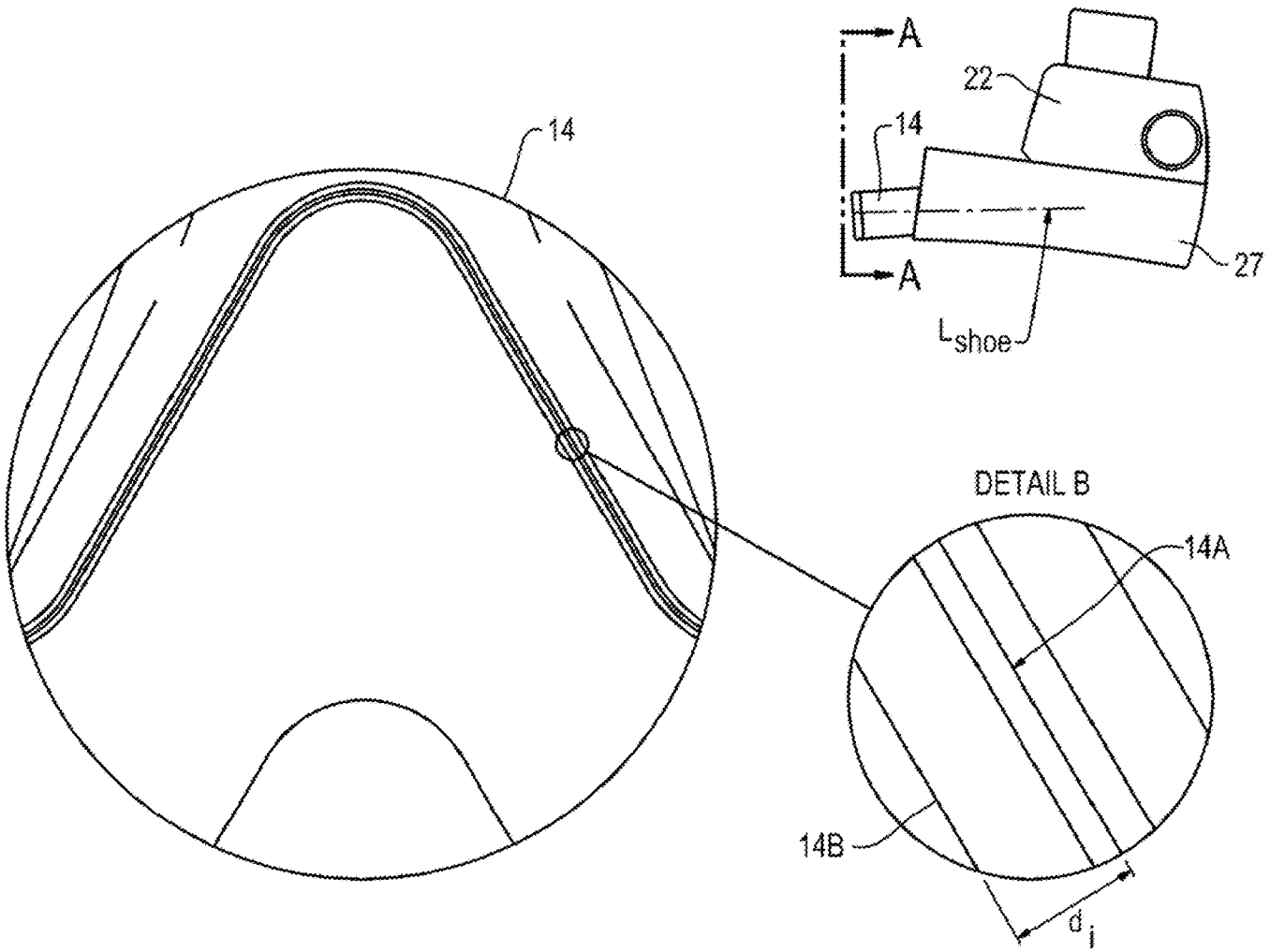
FIGS. 13*a-c* schematically represent interference zones of biased knives in accordance with an aspect this invention.
Figure 13B:
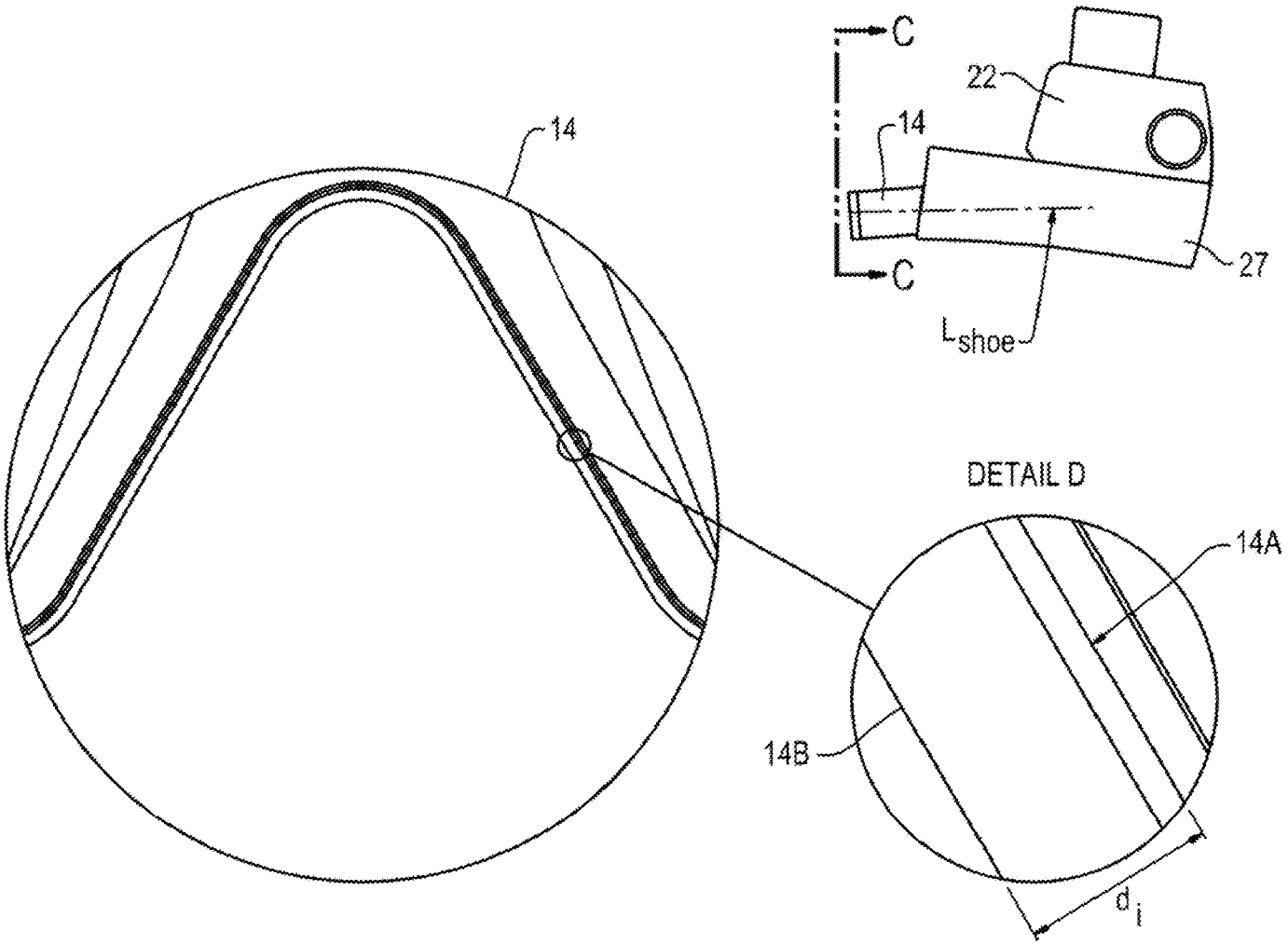
Figure 13C:
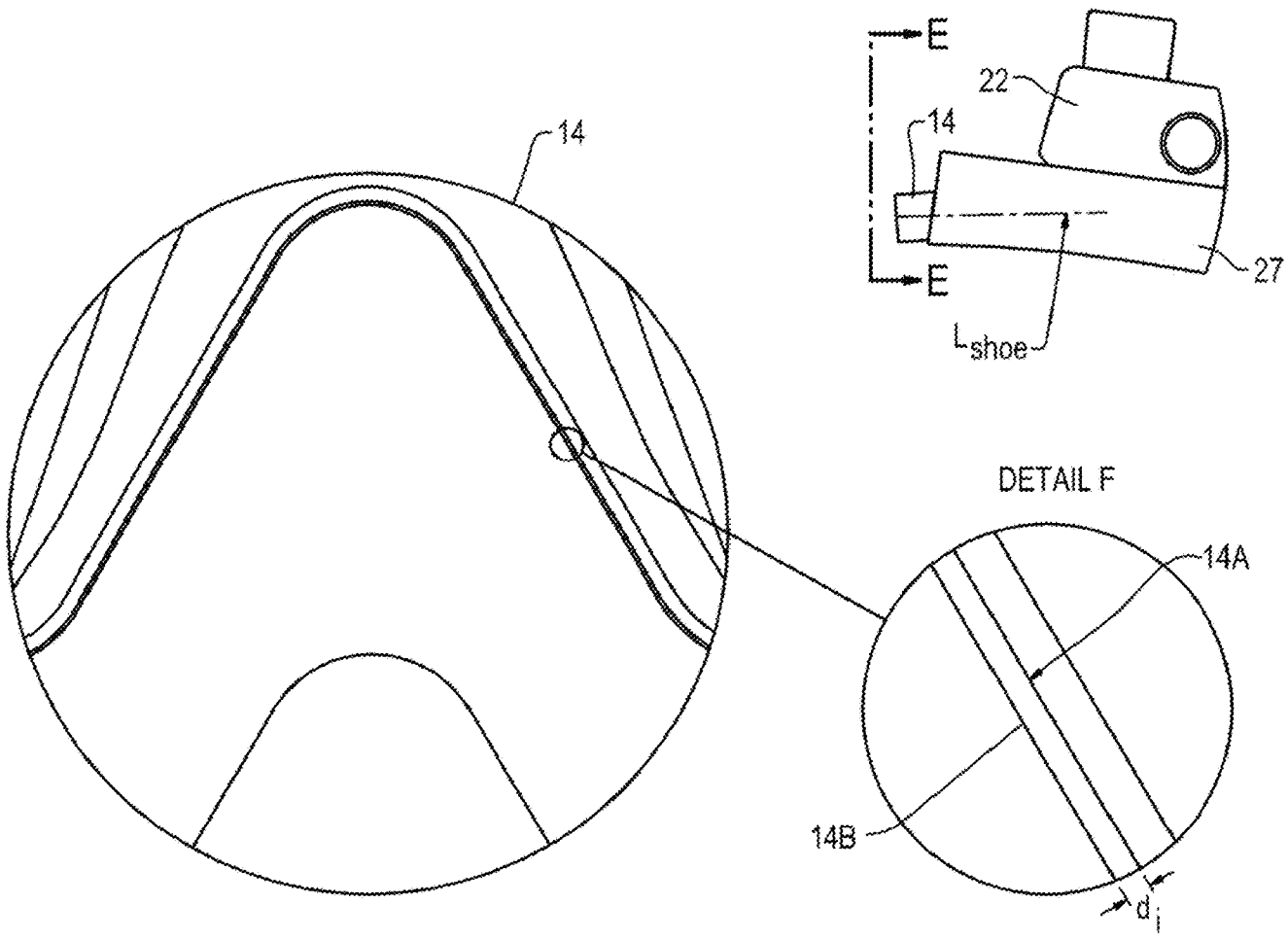

According to a preferred aspect of the invention, an outward position of the knife bevel relative to the impeller 10 has been shown to cause less interference with food products (e.g., potatoes) and the resulting chips during slicing. FIGS. 13*a*, 13*b* and 13*c* help to illustrate the degree of interference for three different knife bevel configurations. The views of FIGS. 13*a*, 13*b* and 13*c* are from the frame of reference of a potato immediately prior to encountering the knife edge. The "interference" presented by the bevel on the knife edge is shown on FIGS. 13*a* through 13*c* in the respective connected detail views B, D, and F. As used herein, interference refers to the extent to which any portion of the knife 14 intrudes on the radial path of the potato during slicing as a result of the portion protruding farther toward the impeller 10 than the knife tip 14*a* of the knife 14. Such a protruding portion, referred to herein as the radially innermost local extremity 14*b* of the knife 14, is believed to cause the slice to have a decreasing taper, sometimes to zero thickness. As discussed below, protrusion of the radially innermost local extremity 14*b* of the knife 14 is preferably, and in some cases must be, limited to less than 0.004 inch (about 0.1 mm) to avoid excessive slice taper.

As seen by a comparison of FIGS. 13*a*, 13*b*, and 13*c*, a double bevel shown in FIG. 13*a* represents a particular degree of interference as evidenced by a dimension ("$d_i$") between the knife tip 14*a* and the radially innermost local extremity 14B of the knife 14. FIG. 13*b* shows an inward biased bevel configuration (bevel facing the impeller 10) that presents greater interference than that of FIG. 13*a*, whereas FIG. 13*c* shows an outward biased bevel configuration (bevel facing away from the impeller 10) that presents much less interference than that of FIG. 13*a*. During investigations pertaining the issue of interference, knives with interferences of less than 0.004 inch (about 0.1 mm), more preferably less than less than 0.003 inch (about 0.08 mm) and most preferably less than 0.001 inch (about 0.025 mm) achieved with biased bevels having a grind angle of between about 7 and 11 degrees were determined to provide improved slice quality, whereas interferences exceeding 0.004 inch resulted in unacceptable slice quality.

Figure 14:
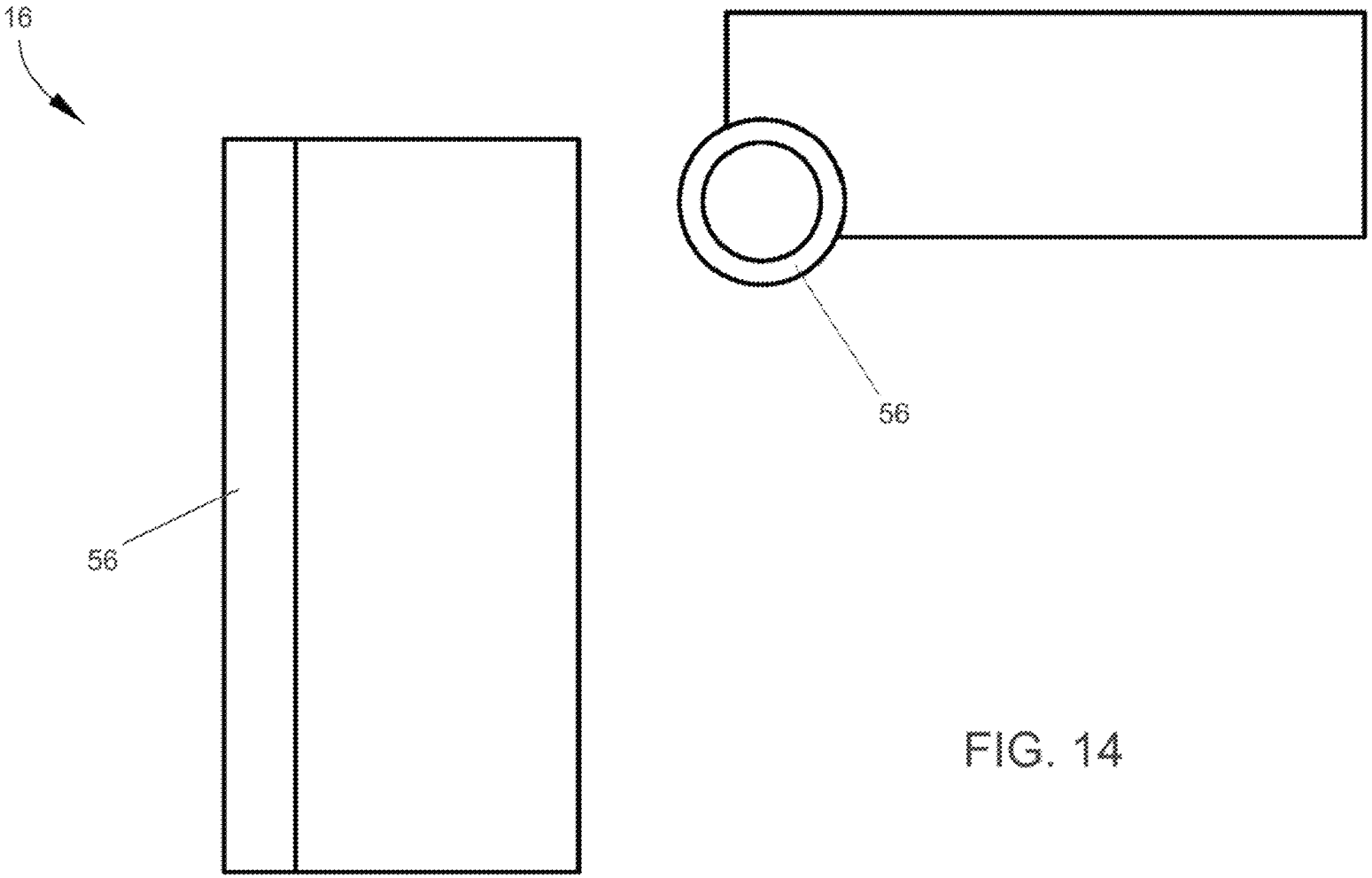
FIG. 14 is cross-sectional and top views representing an impeller with an impact absorbing material on the side of the impeller that impacts food product in accordance with an aspect of this invention.

During investigations leading to the present invention, it was noticed that the food product was sustaining flesh impact damage resulting from contact with the rotating impeller paddles 16. This food product damage leads to finished product quality reductions, additional waste generation, and additional starch release, all negative consequences. During development, positive paddle angles of between 5 to 35 degrees were determined to reduce damage to the food product. Therefore, according to another aspect of the invention, the impeller paddles 16 are preferably inclined at a positive angle (the terms "positive" and "negative" in relation to paddle inclination are defined in FIG. 4), ranging from as little as 5 degrees to about 35 degrees to the radials of the impeller 10. One embodiment positions the paddle angle at about 13.5 degrees, though it is foreseeable that other paddle angles could have different benefits. More preferably, the paddles are at a positive angle of about 8 to 20 degrees, and more preferably about 12 to 15 degrees. The impeller paddles 16 may be equipped with means for absorbing impacts, for example, a gel-facing or an impact absorbing material 56 such as a compressible hose or other material that deforms under impact as represented in FIG. 14, to gently catch and hold food products during slicing. The impact absorbing material or coating may cover the entire impeller paddle 16 of a portion thereof. Alternatively, the food products could be radially accelerated until their radial velocity more closely matches the radial velocity of the impeller paddles 16 to reduce the inevitable product damage resulting from near-stationary food product being impacted by the rotating impeller paddles 16.

Based on these same investigations, it was also identified that slices with inconsistent slice thickness came in groups, indicating that thickness inconsistency was partially related to impeller 10 contact with the product. It was determined that a solid planar impeller paddle surface, when pushing against a asymmetric product, where contact is not in line with the product's center of mass, can generate a torque on the product. This resultant torque can disturb the position of the product during the slicing process resulting in inconsistent slice thickness as the slice progresses. In one embodiment, the impeller 10 can be configured with deformable paddle surfaces which can conform to the shape of the product, thus spreading out the forces associated with the contact surface, which results in lower torque generation and more uniform slice thickness.

Figure 15:
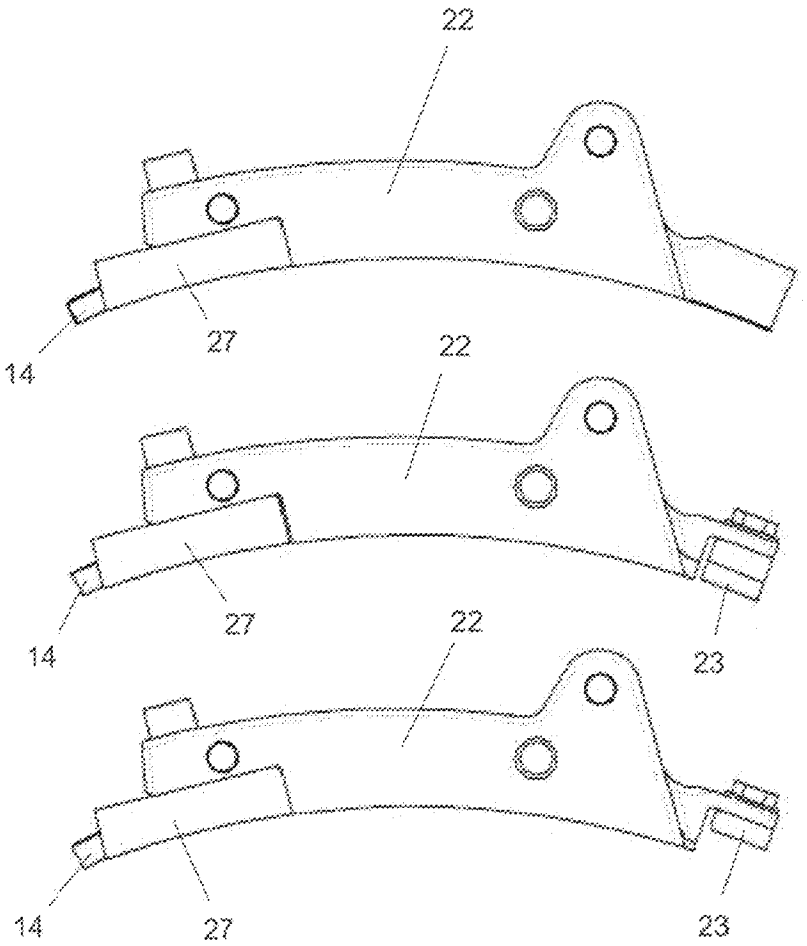
FIG. 15 is a side view representing a profile of three types of knife assemblies in accordance with an aspect of this invention.
Figure 16:
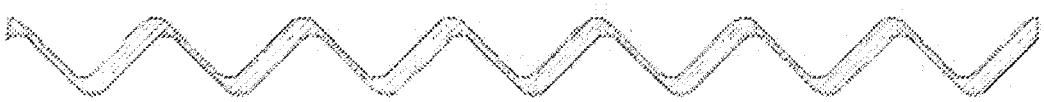
FIG. 16 is a cross-sectional view showing phase misalignment in a chip.

During the development of the present invention, shoes 22 with and without gate insert strips 23 were also investigated (FIG. 15). A gate insert strip 23 is the last part of a slicing shoe 22 contacted by the food product prior to engaging the knife 14 mounted on the immediately trailing shoe 22. As was described in reference to FIGS. 1 through 4, the gate insert strip 23 at the end of a shoe 22 is typically adjustable for slice thickness. A shoe 22 comprising the gate insert strips often has the capability to "true up" the end of the shoe 22 to maintain slice quality after wearing. In contrast, a shoe 22 without the gate insert strips 23 extends all the way to the tip 14*a* of the knife 14. Often for potato slicing, shoes 22 have flat gates to minimize damage to the knife 14 and knife holder 27 from rocks, sand, and other debris. However, during testing to produce potato chips having large-amplitude corrugations of the type represented in FIG. 9, it was determined that phase misalignment occurred in consecutive slices produced with shoes 22 having flat gates. Phase alignment is critical when slicing a dehydrated product, for example, fried or baked potato chips, because the thin-thick cross section of a misaligned phase (FIG. 16) results in over- and under-cooking of a single chip with corresponding results in burnt flavor, breakage, and/or spoilage.

In response, corrugated gate insert strips 23 were evaluated for the purpose of maintaining alignment of potatoes during slicing. However, it was found that similar misalignment occurred in the slices. The gate insert strips 23 were examined and their corrugations were found to be aligned with the corrugations on the interior of the shoes 22, but not with sufficient accuracy to avoid slice corrugation misalignment. Attempts to precisely align the corrugations of the gate insert strips 23 with the corrugations of the shoes 22 proved to be successful when gate insert strips 23 were accurately aligned using alignment means such as with mating pins and pin holes 52 (FIG. 8). Shoes 22 without gate insert strips 23 were also evaluated having corrugations that extend all the way to the trailing edge of the shoe 22 as shown in FIG. 5. The corrugated shoes 22 without gate insert strips 23 also provided greatly improved alignment of potatoes prior to slicing, and at lower manufacturing cost than pin holes 52.

Once it was determined that alignment of the entire shoe 22, including the gate insert strip 23, was effective for maintaining the phase alignment of slices, it was concluded that accurately aligned corrugations in the interior surface of the knife holders 27 would also promote and maintain alignment of the food product with the shoes 22 and knives 14. This role can be fulfilled with pin holes 52 described in reference to FIG. 8 above. By ensuring manufacturing tolerances of the pin holes 52 and complementary pins (not shown) provided on the shoes 22, accurate alignment between each knife holder 27 and its shoe 22 can be achieved.

Figure 17:
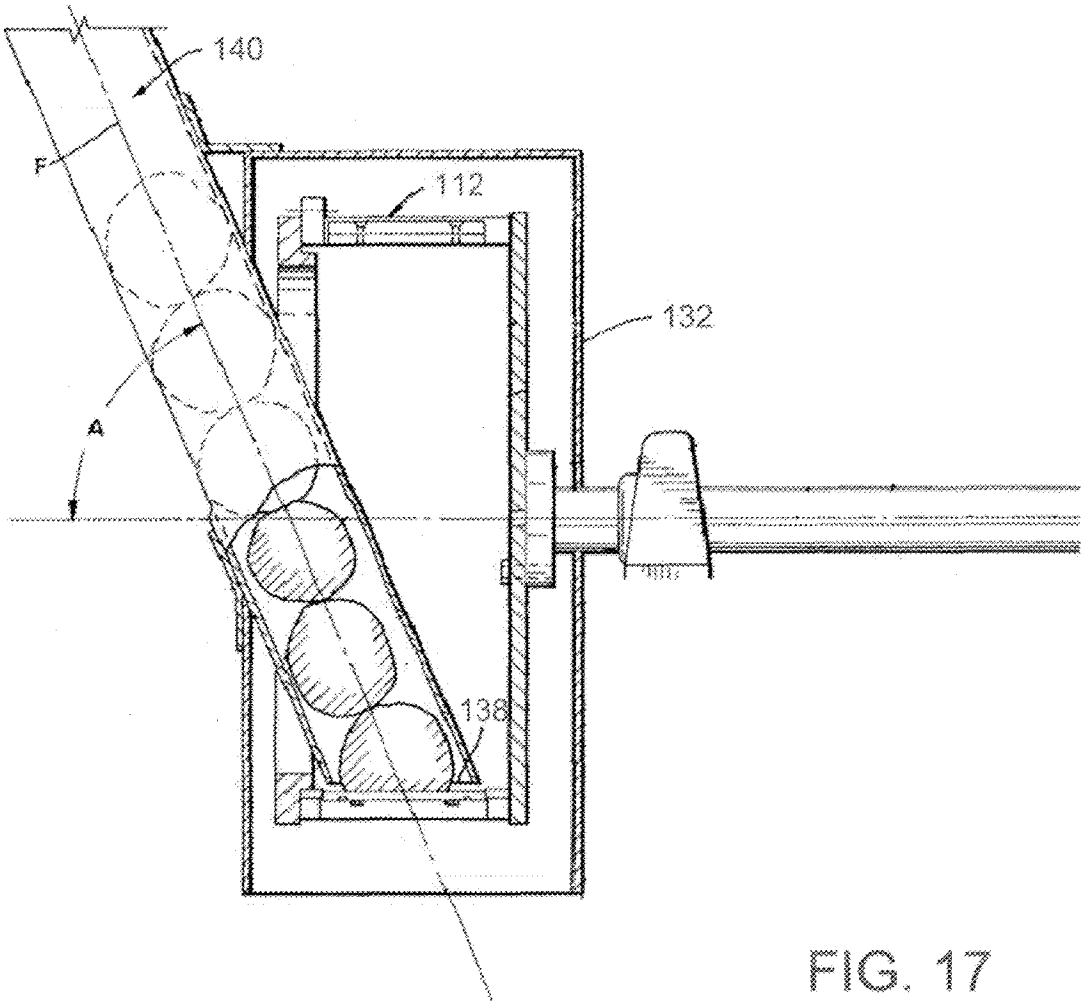
FIG. 17 (Prior Art)
FIG. 17 is a side view representing a cutting apparatus, with partial cutaways to expose a cutting head within the cutting apparatus in accordance with an aspect this invention.

According to a second embodiment, the invention is also applicable to a cutting apparatus configured as shown in FIG. 17 as having a cutting head 112 mounted upright and rotated about a horizontally disposed central axis, wherein food product is feed through an opening on a side of the cutting head 112. For example, in FIG. 17 the cutting apparatus is represented as comprising a housing 132, a stationary hollow elongate feed chute 140, and a cylindrical-shaped rotary cutting head 112. The feed chute 140 extends along a longitudinal axis through the housing 132 and a circular-shaped front opening of the cutter head 112. A plurality of food products stacked within the feed chute 140 in a linear array are caused to consecutively be fed through an outlet opening 138 of the feed chute 140 and engage a circumferential wall defined in part by at least one knife assembly of the cutting head 112 approximately midway between the opposite ends of the wall and spaced rearwardly of the axis of rotation with respect to the direction of cutting head rotation to dispose the outlet opening 138 of the feed chute 140 adjacent the lower circumferential wall portion of the cutting head 112 so that each food product is caused to engage the lower circumferential wall portion of the cutting head 112 for slicing by the knife 114 during rotation of the cutting head 112.

Figure 18:
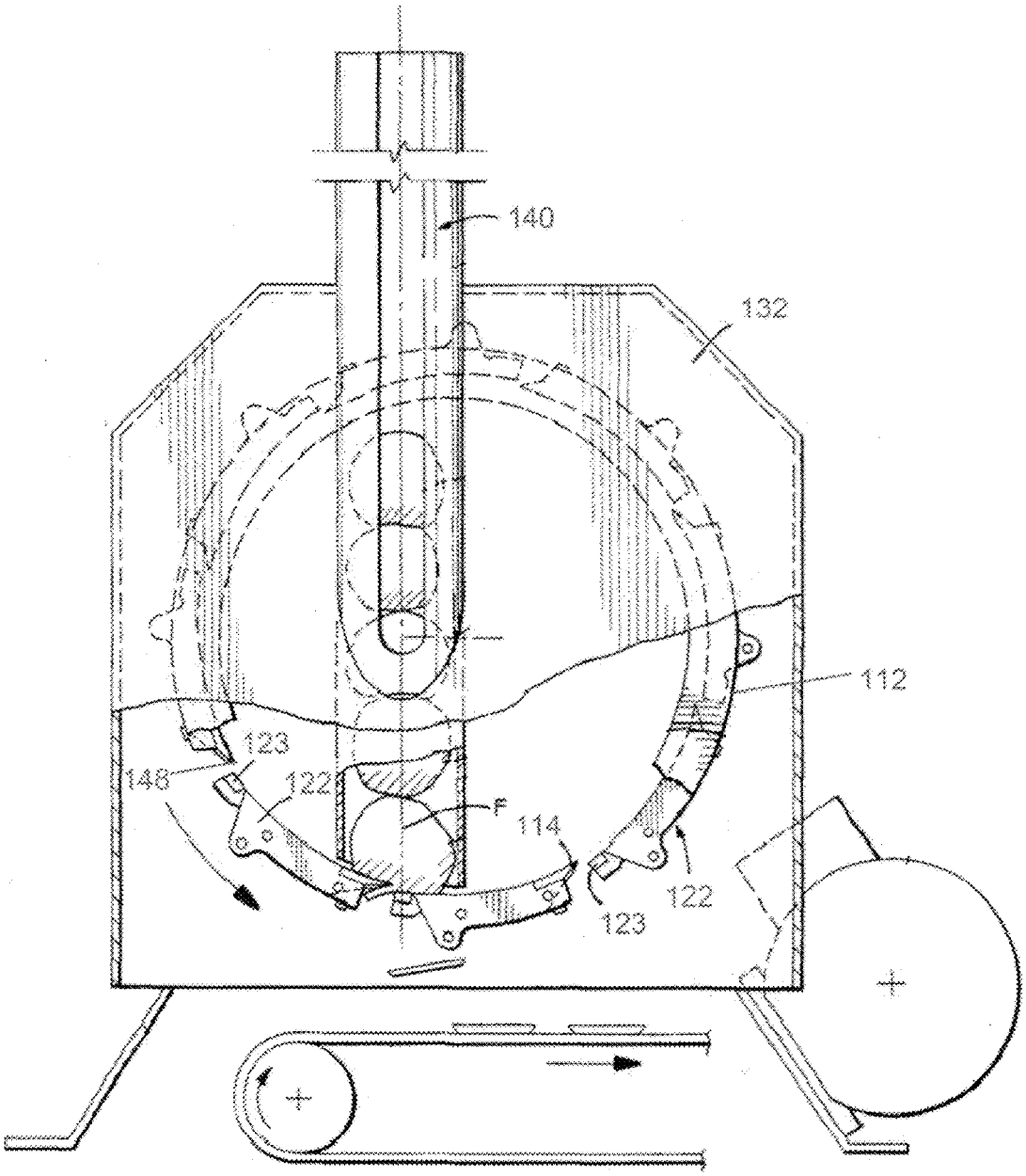
FIG. 18 (Prior Art)
FIG. 18 is a side view of the cutting apparatus of FIG. 17, with partial cutaways to expose the cutting head within the cutting apparatus.

With reference to FIG. 18, the cutting head 112 is defined by one or more knife assemblies, wherein each knife assembly comprises a knife 114 at its leading end and a gauge plate 123 at its trailing end with respect to the direction of rotation of cutting head 112 as indicated by an arrow, and a shoe 122 securing the knife 114 and gauge plate 123 are secured to the cutting head 112 with a shoe 122. The knives 114 extend axially of the cutting head 112 and are disposed parallel to each other and to an axis of rotation R. As the food products are fed against the cutting head 112, they are caused to be brought into the path of the knives 114 during rotation of the cutting head 112, whereby each knife 114 is caused to cut through the food product and remove a slice therefrom. The thickness of a slice is predetermined by adjusting the position of the gauge plate 123 relative to the cutting edge 148 of the knife 114. Though multiple knives 114 are shown for the cutting head 112, it is foreseeable that it may be desirable to utilize a lesser number of knives 114 or even only a single knife 114. Preferably, the cutting head 112 and knife assemblies are similar to the cutting head 112 and knife assemblies represented in FIGS. 5, 8, 11*e*, 12, and 13*c*. For example, the knives 114 have a corrugated shape to produce a food product slice with generally parallel cuts to yield food product slices having large-amplitude cross-sections. However, it is foreseeable that adjustments may be necessary to accommodate the vertical positioning of the cutting head 112. Further details regarding the general arrangement and operation of the cutting apparatus represented in FIGS. 17 and 18 are disclosed in U.S. Pat. No. 4,813,317 to Urschel et al., the contents of which are incorporated herein by reference.

Figure 19:
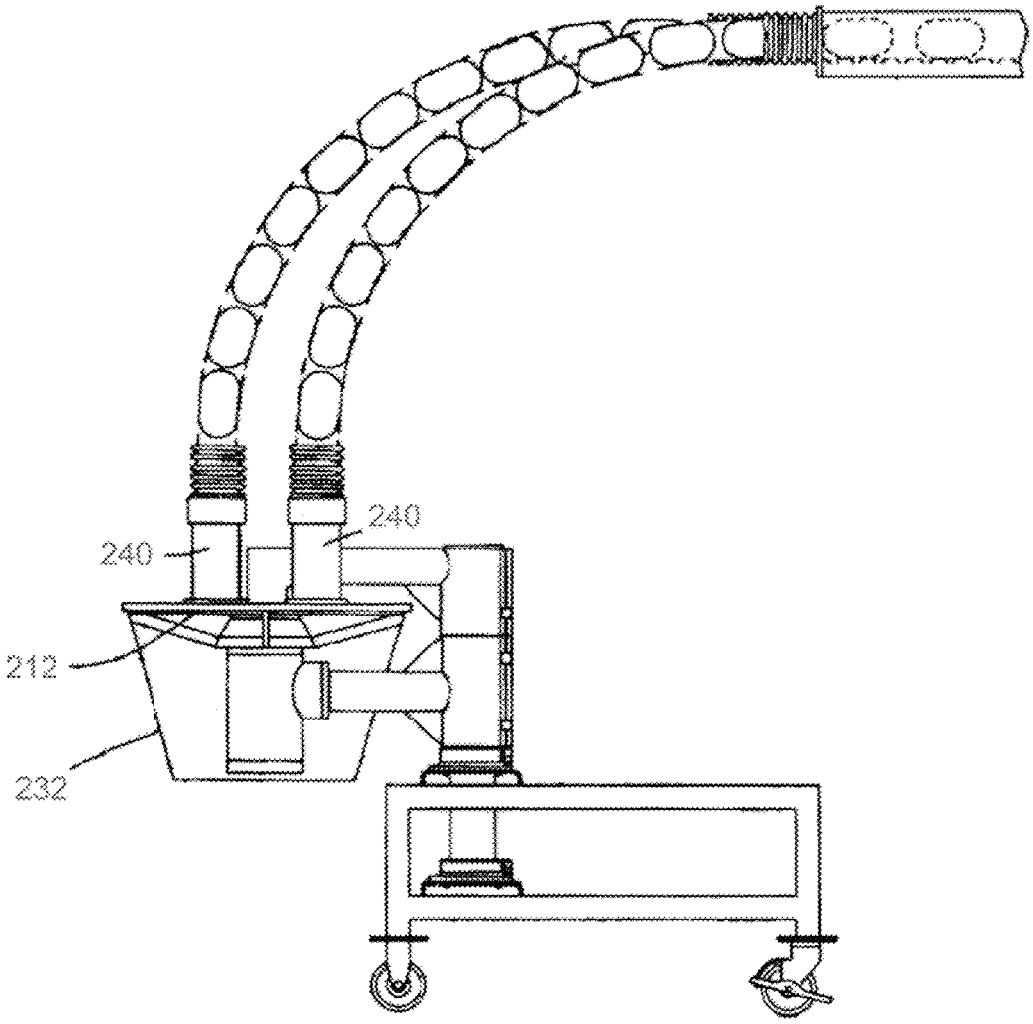
FIG. 19 (Prior Art)
FIG. 19 is a side view representing a cutting apparatus, with partial cutaways to expose a cutting head within the cutting apparatus in accordance with an aspect this invention.

According to a third embodiment, the invention is further applicable to a cutting apparatus configured as shown in FIGS. 19 through 23. FIG. 19 represents the cutting apparatus as comprising a housing 232, a feed tube 240, and a horizontally disposed rotatable cutting wheel 212. Food product is delivered through the feed tubes 240 mounted to the top of the housing 232. The feed tubes 240 advance the food product in a feed direction towards the cutting wheel 212 within the housing 232.

Figure 20:
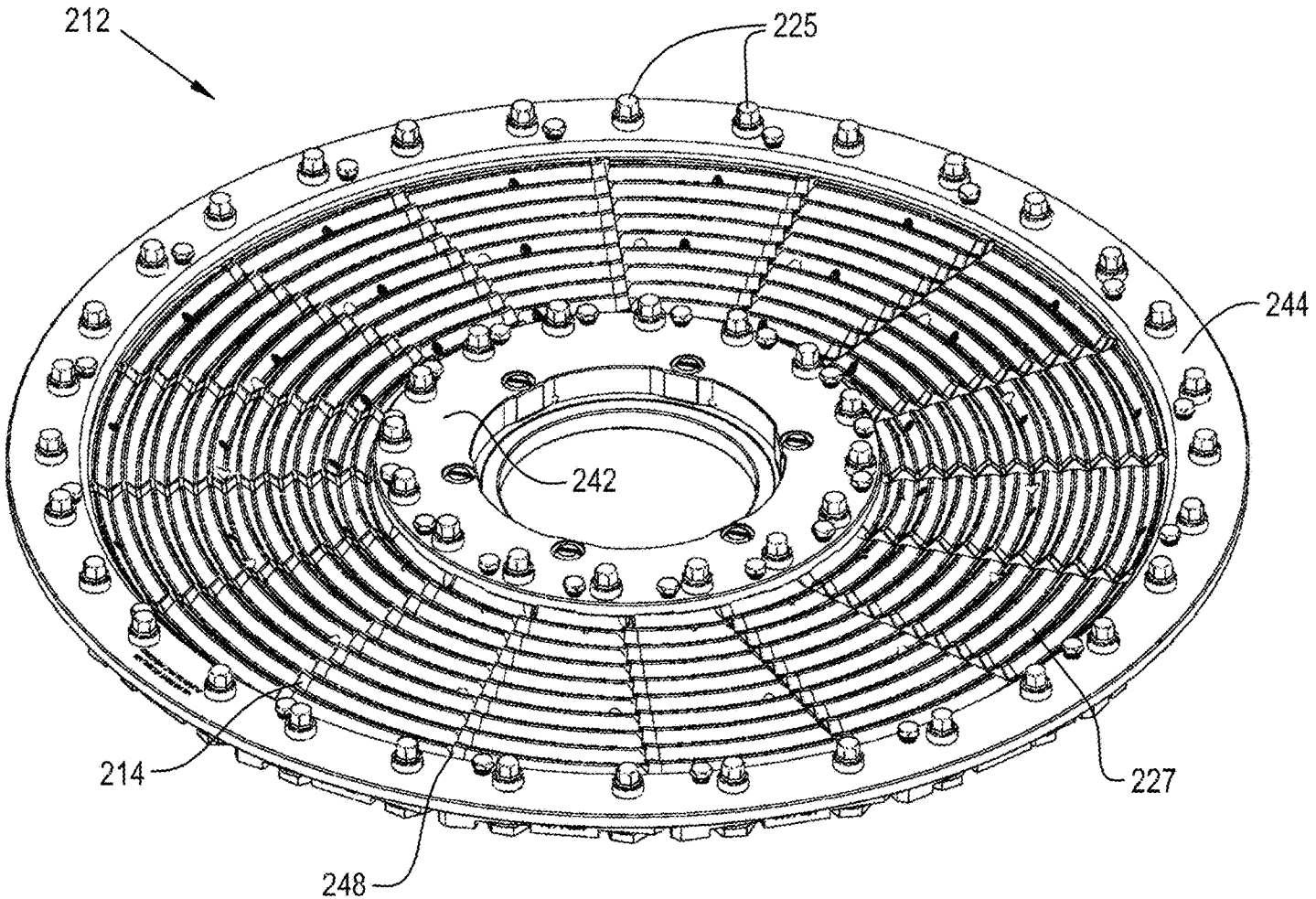
FIGS. 20-21 are perspective views representing a cutting wheel in accordance with an aspect this invention.
Figure 21:
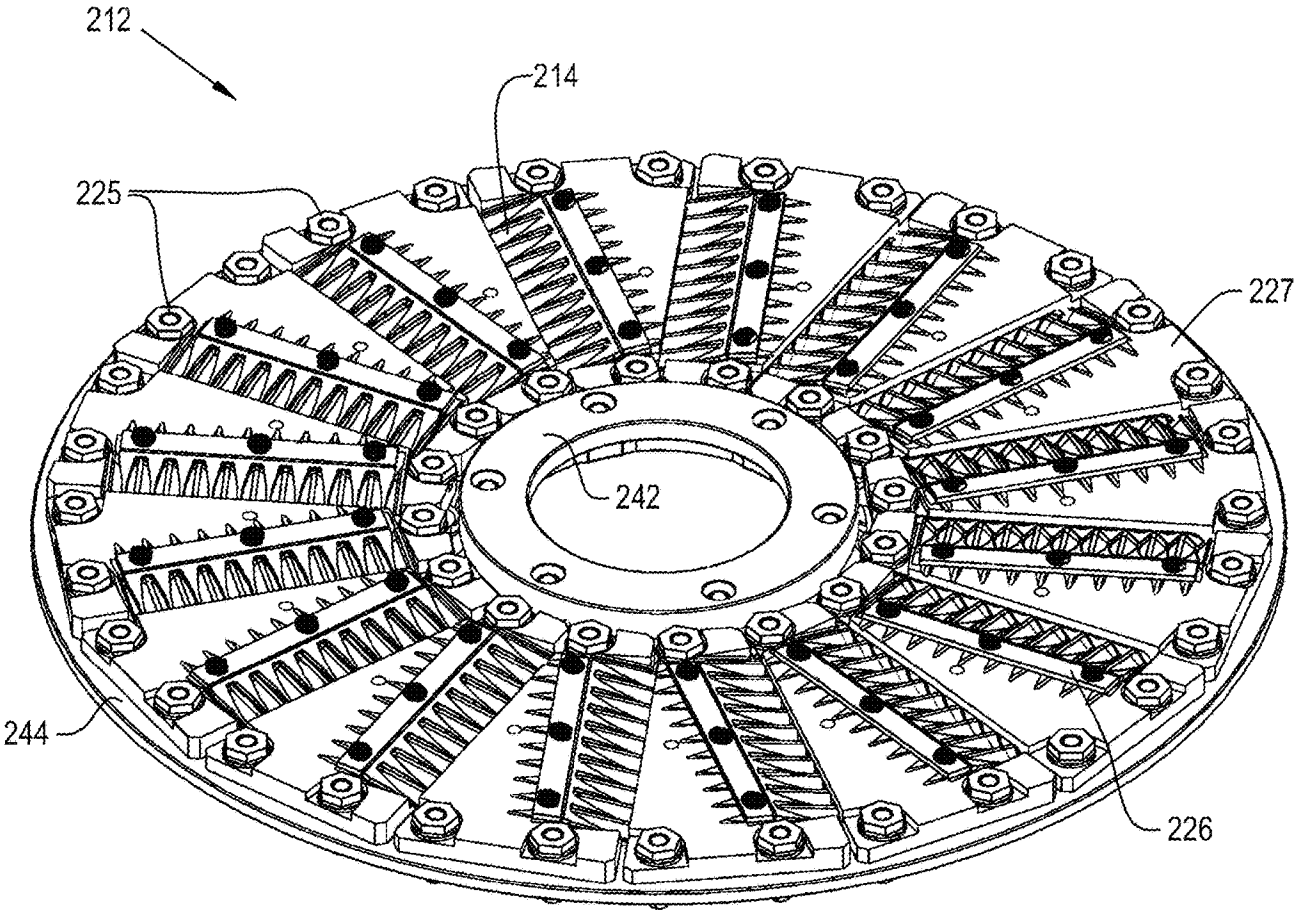
Figure 22:
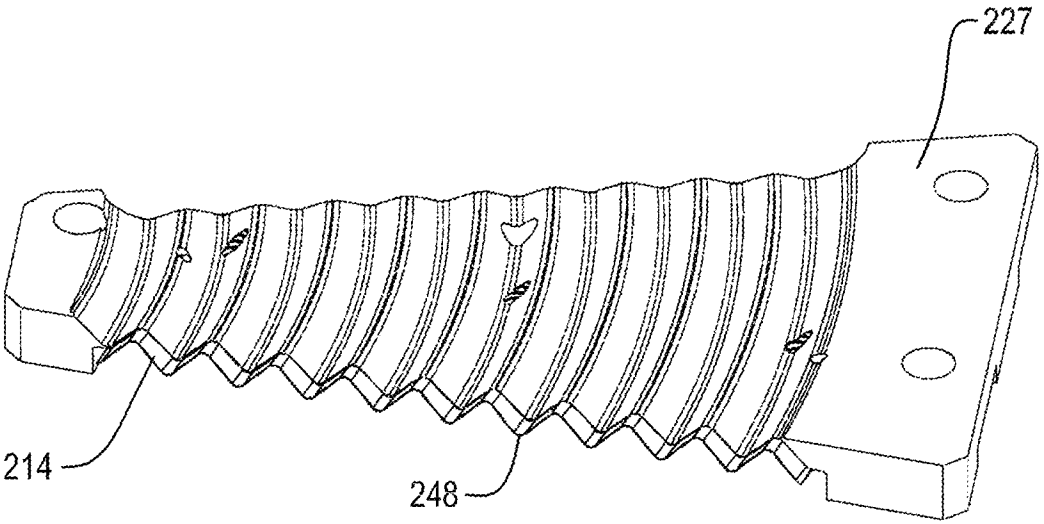
FIGS. 22-23 are perspective views representing a knife assembly for a cutting wheel in accordance with an aspect this invention.
Figure 23:
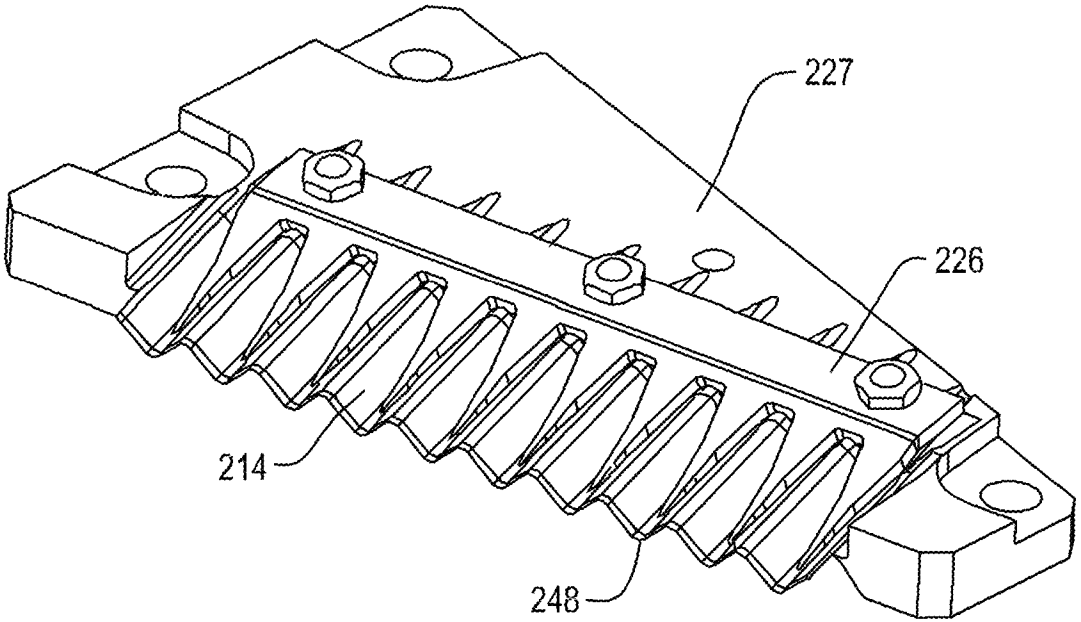

The cutting wheel 212 is represented in FIGS. 20 and 21 as comprising at least one knife assembly and preferably a plurality of knife assemblies oriented about the central axis of the cutting wheel 212. As represented in FIGS. 22 and 23, each knife assembly comprises a knife holder 227, a clamping assembly 226, and a knife 214. The knife assemblies are secured to a hub 242 and a rim 244 of the cutting wheel 212 by bolts 225. The knives 214 have leading edges facing a direction of rotation of the cutting wheel 212 and extend generally radially from the hub 242 to the rim 244. A cutting edge 248 on the leading edge of the knives 214 and a second edge on the trailing edge of the knife assemblies with respect to the direction of cutting wheel 212 rotation form a juncture. The juncture extending substantially parallel to and spaced in the food product feed direction from the cutting edge 248 of the next adjacent knife 214 located in a trailing direction so as to form an opening therebetween. The opening determines a thickness of the sliced food product engaging the knives 214 while the cutting wheel 212 is rotated about a central axis to advance the cutting edges 248 in a cutting plane. Similar to the previous embodiments, the knives 214 have corrugated shapes to produce food product slices with generally parallel cuts to yield food product slices having large-amplitude cross-sections. The construction, orientation, and operation of the knife assemblies and their components are similar to the embodiments represented in FIGS. 5, 8, 11*e*, 12, and 13*c* although modifications may be necessary to accommodate the cutting wheel design.

From FIG. 19, it can be seen that the cutting apparatus singulates and orients the food product before delivering the food product in a substantially vertical direction to the feed tubes 240, which are also shown as being vertically oriented. The generally vertical presentation of the food product is due to the substantially horizontal orientation of the cutting wheel 212. While the feed tubes 240 are shown as being oriented at about 90 degrees to the surface (plane) of the cutting wheel 212, it is foreseeable that other orientations could be used, depending on the angle at which cuts are desired through the food product. However, the cutting wheel 212 is preferably disposed in the horizontal plane, and the feed tubes 240 are disposed at an angle of about 15 to about 90 degrees, preferably about 90 degrees, to the cutting wheel 212. Further details regarding the general arrangement and operation of the cutting apparatus represented in FIGS. 17 through 23 are disclosed in U.S. Pat. No. 6,973,862 to Bucks and U.S. Pat. No. 7,000,518 to Bucks et al., the contents of which are incorporated herein by reference.

While the invention has been described in terms of specific embodiments, it is apparent that other forms could be adopted by one skilled in the art. For example, the impeller 10 and cutting head 12 could differ in appearance and construction from the embodiments shown in the Figures, the functions of each component of the impeller 10 and cutting head 12 could be performed by components of different construction but capable of a similar (though not necessarily equivalent) function, and various materials and processes could be used to fabricate the impeller 10 and cutting head 12 and their components. Therefore, the scope of the invention is to be limited only by the following claims.

The invention claimed is:

1. An apparatus for slicing food product to produce food product slices, the apparatus comprising a rotatable cutting wheel having a hub, a rim and two or more knife assemblies, the food product advancing toward the cutting wheel in a feed direction, each knife assembly comprising;

a knife extending generally radially from the hub to the rim, the knife having a leading edge facing a direction of rotation of the cutting wheel and a large-amplitude corrugated shape characterized by peaks and valleys that define a cross-section with an amplitude of 2.5 millimeters or greater;

means for securing the knife to the hub and rim, the securing means comprising a knife holder and a clamp securing the knife to a first surface of the knife holder; and means for providing continuous and accurate alignment of an individual food product throughout the slicing thereof by the knife of a first of the knife assemblies and then the knife of a second of the knife assemblies that trails the first knife assembly in a trailing direction with respect to the direction of cutting wheel rotation to produce the food product slices with a generally parallel-cut cross-section having a uniform thickness and a large-amplitude periodic shape characterized by peaks and valleys that define a cross-section with an amplitude of 2.5 millimeters or greater, the alignment means comprising a corrugated shape on a second surface of the knife holder opposite the first surface, the corrugated shape of the second surface of the knife holder corresponding to the corrugated shape of the knife thereof;

wherein the leading edge of the knife of each of the first and second knife assemblies defines a cutting edge thereof and the knife holder of each of the first and second knife assemblies defines a trailing edge thereof with respect to the direction of cutting wheel rotation, the trailing edge of the first knife assembly and the cutting edge of the second knife assembly forming a juncture extending substantially parallel to and spaced in the food product feed direction between the trailing edge of the first knife assembly and the cutting edge of the second knife assembly so as to form an opening therebetween, the opening determining a thickness of the food product slices produced by the cutting edge of the second knife assembly while the cutting wheel is rotated about a central axis to advance the knife assemblies in a cutting plane, the cutting edge of the second knife assembly and the trailing edge of the first knife assembly defining a rake-off angle of at least 17 degrees and less than 23 degrees that reduces cracking of the food product slices by reducing stresses therein.

2. The apparatus according to claim 1, wherein the amplitude of the cross-section of the corrugated shape of the knife of each knife assembly is 2.5 to 9 millimeters.

3. The apparatus according to claim 1, wherein the amplitude of the cross-section of the corrugated shape of the knife of each knife assembly is 3 to 7 millimeters.

4. The apparatus according to claim 1, wherein the amplitude of the cross-section of the corrugated shape of the knife of each knife assembly is 3.8 to 5.7 millimeters.

5. The apparatus according to claim 1, wherein the rake-off angle is less than 20 degrees.

6. The apparatus according to claim 1, wherein the rake-off angle is 17 degrees.

7. The apparatus according to claim 1, wherein the knife of each knife assembly has a biased bevel comprising a bevel that faces away from the food product as the food product is fed towards the cutting plane.

8. The apparatus according to claim 7, wherein the bevel of the biased bevel has a grind angle of 7° to 11°.

9. The apparatus according to claim 1, wherein the entirety of the second surface of the knife holder of each knife assembly is continuously and uniformly corrugated.

10. The apparatus according to claim 1, wherein the securing means of each knife assembly comprises fingers that engage the valleys defined by the corrugated shape of the knife thereof.

11. The apparatus according to claim 10, wherein the fingers of the securing means is beveled on a side of the securing means facing the food product as the food product is fed towards the cutting plane.

12. The apparatus according to claim 1, wherein the cutting edge of the knife of each knife assembly comprises a knife tip and a local extremity that protrudes farther toward the food product as the food product is fed towards the cutting plane than the knife tip by a distance of less than 0.1 millimeter.

* * * * *